US009056241B2

(12) United States Patent
Green

(10) Patent No.: US 9,056,241 B2
(45) Date of Patent: Jun. 16, 2015

(54) ROLLER SKATE

(71) Applicant: Cardiff Sports Technologies, LLC, Cardiff, CA (US)

(72) Inventor: Brian Green, Oak View, CA (US)

(73) Assignee: Cardiff Sport Technologies, LLC, Cardiff, CA (US)

( * ) Notice: Subject to any disclaimer, the term of this patent is extended or adjusted under 35 U.S.C. 154(b) by 0 days.

(21) Appl. No.: 14/148,985

(22) Filed: Jan. 7, 2014

(65) Prior Publication Data

US 2014/0131962 A1 May 15, 2014

Related U.S. Application Data

(63) Continuation-in-part of application No. 13/608,040, filed on Sep. 10, 2012, now Pat. No. 8,727,359, which is a continuation-in-part of application No. 13/066,502, filed on Apr. 15, 2011, now Pat. No.

(Continued)

(51) Int. Cl.
*A63C 1/26* (2006.01)
*A63C 17/00* (2006.01)
(Continued)

(52) U.S. Cl.
CPC ..... *A63C 17/0086* (2013.01); *A63C 17/004* (2013.01); *A63C 17/04* (2013.01); *A63C 17/1418* (2013.01); *A63C 17/262* (2013.01)

(58) Field of Classification Search
USPC ..... 280/11.19, 11.204, 11.208, 11.209, 280/11.221–11.224, 11.231, 11.27, 11.26
See application file for complete search history.

(56) References Cited

U.S. PATENT DOCUMENTS 177,566 A 5/1876 Saladee
196,230 A 10/1877 Hutton
(Continued)

FOREIGN PATENT DOCUMENTS

EP 0559179 A1 9/1993
EP 0573677 12/1993
(Continued)

OTHER PUBLICATIONS

European Search Report for European Patent Application No. 11820289.4, mailed Feb. 6, 2015, Authorized Officer: Haller, E.

*Primary Examiner* — Jeffrey J Restifo
*Assistant Examiner* — Erez Gurari
(74) *Attorney, Agent, or Firm* — Sheppard Mullin Richter & Hampton LLP

(57) ABSTRACT

A roller skate having enhanced durability and stability is disclosed. Furthermore, the roller skate is particularly adapted for affixing to a person's footwear, such as sneakers, boots or the like. The skate includes a platform for supporting a skater's foot. The platform includes a toe plate and heel plate connected by an adjustable connecting assembly. A front truck is affixed to the underside of the toe plate, while a rear truck is affixed to the underside of the heel plate. The front truck includes simple bracket arms for affixing a single front wheel which is capable of rotating, but not capable of tilting about the platform's longitudinal axis. Meanwhile, the rear wheel truck is mounted to the underside of the heel plate so as to permit both tilting movement about an inclined longitudinal axis, and also rotation about a transverse axis relative to the roller skate's platform. Preferably, the roller skate includes three wheels rotatably mounted to the rear wheel truck. A button projects upwardly from the roller skate's rear truck so as to engage a skater's heel when it is placed upon the roller skate's platform. The button is connected to the roller skate's connecting assembly so that depression of the button causes the platform to unlock from an extending condition to allow the skate to automatically contract to capture a skater's foot.

13 Claims, 25 Drawing Sheets

Related U.S. Application Data

8,348,284, which is a continuation-in-part of application No. 12/807,085, filed on Aug. 27, 2010, now Pat. No. 8,292,308, which is a continuation-in-part of application No. 12/590,877, filed on Nov. 16, 2009, now Pat. No. 8,251,377.

(51) Int. Cl.

| | |
|---|---|
| ***A63C 17/04*** | (2006.01) |
| ***A63C 17/14*** | (2006.01) |
| ***A63C 17/26*** | (2006.01) |

(56) References Cited

U.S. PATENT DOCUMENTS

| | | | | | |
|---|---|---|---|---|---|
| 208,235 | A | | 9/1878 | Gregg | |
| 218,035 | A | | 7/1879 | Lash | |
| 308,744 | A | | 12/1884 | Brix | |
| 321,931 | A | | 7/1885 | Brown | |
| 321,980 | A | | 7/1885 | Kitselman et al. | |
| 324,327 | A | * | 8/1885 | Jacoby | 280/11.19 |
| 330,652 | A | * | 11/1885 | Whitaker | 280/11.26 |
| 1,194,102 | A | | 8/1916 | Webb | |
| 1,271,891 | A | | 7/1918 | Gustin | |
| 1,603,588 | A | * | 10/1926 | Eberle | 280/11.15 |
| 1,609,612 | A | | 12/1926 | Eskeland | |
| 1,617,984 | A | | 2/1927 | Biggio | |
| 1,632,997 | A | | 6/1927 | Connolly | |
| 1,771,855 | A | | 4/1929 | Macmillan | |
| 1,809,612 | A | | 6/1931 | Van Dorn | |
| 1,975,905 | A | | 10/1934 | Specht | |
| 1,989,344 | A | * | 1/1935 | Tracey | 280/11.26 |
| 2,097,721 | A | | 11/1937 | Cledina | |
| 2,137,330 | A | * | 11/1938 | Brazel | 280/11.26 |
| 2,245,769 | A | | 6/1941 | Alexander | |
| 2,430,037 | A | | 11/1947 | Vincent | |
| 2,474,082 | A | * | 6/1949 | Wutz | 280/11.19 |
| 2,732,217 | A | | 1/1956 | Dore | |
| 3,008,725 | A | | 11/1961 | Stites | |
| 3,061,325 | A | * | 10/1962 | Glass | 280/613 |
| 3,202,435 | A | * | 8/1965 | Goodman | 280/11.26 |
| 3,396,985 | A | * | 8/1968 | Kipnis | 280/11.26 |
| 3,635,854 | A | * | 1/1972 | Martin | 280/11.26 |
| 3,649,038 | A | * | 3/1972 | Huckenbeck | 280/11.28 |
| 3,936,061 | A | * | 2/1976 | Wada | 280/11.226 |
| 3,953,041 | A | * | 4/1976 | Buss | 280/11.26 |
| 4,134,598 | A | * | 1/1979 | Urisaka | 280/842 |
| 4,272,090 | A | * | 6/1981 | Wheat | 280/11.231 |
| 4,272,091 | A | * | 6/1981 | Reid, Jr. | 280/11.28 |
| 4,351,538 | A | | 9/1982 | Berta | |
| 4,382,605 | A | | 5/1983 | Hegna | |
| 4,398,734 | A | | 8/1983 | Barnard | |
| 4,523,767 | A | | 6/1985 | Le Page | |
| 4,572,529 | A | | 2/1986 | Thomas | |
| 4,817,974 | A | * | 4/1989 | Bergeron | 280/11.209 |
| 4,932,676 | A | * | 6/1990 | Klamer | 280/11.201 |
| 4,966,377 | A | * | 10/1990 | Yu | 280/11.209 |
| 5,180,176 | A | | 1/1993 | Chen | |
| 5,192,088 | A | * | 3/1993 | Yu | 280/11.225 |
| D337,365 | S | * | 7/1993 | Gertler | D21/764 |
| 5,224,718 | A | * | 7/1993 | Gertler | 280/11.19 |
| 5,342,071 | A | * | 8/1994 | Soo | 280/11.207 |
| 5,400,484 | A | * | 3/1995 | Gay | 24/593.11 |
| 5,421,596 | A | * | 6/1995 | Lee | 280/11.19 |
| 5,484,149 | A | * | 1/1996 | Lee | 280/11.26 |
| 5,551,713 | A | * | 9/1996 | Alexander | 280/11.19 |
| 5,586,774 | A | * | 12/1996 | Dentale | 280/11.225 |
| 5,620,190 | A | * | 4/1997 | Maggiore | 280/11.201 |
| 5,707,068 | A | * | 1/1998 | Bradfield | 280/87.042 |
| 5,803,467 | A | * | 9/1998 | Piotrowski | 280/7.14 |
| 5,826,895 | A | | 10/1998 | Bradfield | |
| 5,842,706 | A | * | 12/1998 | Chang | 280/11.28 |
| 5,908,196 | A | * | 6/1999 | Weiss | 280/11.19 |
| 5,992,861 | A | * | 11/1999 | Piotrowski | 280/7.14 |
| 6,070,885 | A | * | 6/2000 | Ferone | 280/11.19 |
| 6,120,038 | A | * | 9/2000 | Dong et al. | 280/7.13 |
| 6,120,040 | A | * | 9/2000 | Svensson et al. | 280/11.224 |
| 6,149,167 | A | * | 11/2000 | Kao et al. | 280/11.225 |
| 6,196,557 | B1 | * | 3/2001 | Gerard | 280/11.28 |
| 6,209,888 | B1 | * | 4/2001 | Bozinovic | 280/11.206 |
| 6,209,889 | B1 | * | 4/2001 | Alfieri et al. | 280/11.224 |
| 6,217,039 | B1 | | 4/2001 | Iverson | |
| 6,227,551 | B1 | * | 5/2001 | Roy | 280/11.223 |
| 6,279,921 | B2 | * | 8/2001 | Bozinovic | 280/11.206 |
| 6,322,088 | B1 | * | 11/2001 | Klamer et al. | 280/11.27 |
| 6,406,039 | B1 | | 6/2002 | Chen | |
| 6,431,559 | B1 | * | 8/2002 | Tlucko | 280/11.221 |
| 6,439,584 | B1 | | 8/2002 | Lai | |
| 6,481,726 | B2 | * | 11/2002 | Alfieri et al. | 280/11.224 |
| 6,497,420 | B2 | * | 12/2002 | Ricci | 280/11.16 |
| 6,536,783 | B2 | * | 3/2003 | Gorza et al. | 280/11.204 |
| 6,557,862 | B1 | * | 5/2003 | Gallo | 280/11.204 |
| 6,616,155 | B2 | | 9/2003 | Tuan | |
| 6,679,505 | B2 | | 1/2004 | Yang | |
| 6,712,395 | B1 | * | 3/2004 | Lee | 280/809 |
| 6,750,748 | B2 | | 6/2004 | Byram | |
| 6,755,425 | B2 | | 6/2004 | Gorisch | |
| D493,858 | S | * | 8/2004 | Green et al. | D21/763 |
| 6,786,493 | B2 | * | 9/2004 | Hong | 280/11.26 |
| 6,883,811 | B2 | * | 4/2005 | Tlucko | 280/11.224 |
| 6,918,602 | B2 | | 7/2005 | Lu | |
| 6,921,093 | B2 | * | 7/2005 | Svensson et al. | 280/11.224 |
| 7,121,561 | B2 | * | 10/2006 | Green et al. | 280/11.19 |
| 7,175,187 | B2 | * | 2/2007 | Lyden | 280/11.3 |
| 7,246,803 | B2 | * | 7/2007 | Sauter et al. | 280/11.26 |
| 7,306,240 | B2 | * | 12/2007 | Chen | 280/11.27 |
| 7,407,168 | B2 | * | 8/2008 | Lee | 280/11.26 |
| 7,419,187 | B2 | * | 9/2008 | Haugen et al. | 280/841 |
| 7,464,944 | B2 | * | 12/2008 | Lyden | 280/11.27 |
| 7,618,046 | B2 | * | 11/2009 | Green | 280/11.19 |
| 7,735,841 | B1 | * | 6/2010 | Longino | 280/11.28 |
| 8,029,003 | B2 | * | 10/2011 | Chen | 280/11.26 |
| 8,251,377 | B2 | | 8/2012 | Green et al. | |
| 8,292,308 | B2 | | 10/2012 | Green et al. | |
| 8,348,284 | B2 | | 1/2013 | Green et al. | |
| 2001/0006281 | A1 | * | 7/2001 | Gorza et al. | 280/11.223 |
| 2002/0017764 | A1 | * | 2/2002 | Svensson et al. | 280/11.224 |
| 2002/0030332 | A1 | | 3/2002 | Longino | |
| 2002/0105150 | A1 | * | 8/2002 | Liao et al. | 280/11.223 |
| 2002/0105151 | A1 | * | 8/2002 | Liao et al. | 280/11.223 |
| 2003/0052463 | A1 | | 3/2003 | Tlucko | |
| 2003/0057665 | A1 | | 3/2003 | Matney | |
| 2003/0116930 | A1 | | 6/2003 | Gorisch | |
| 2003/0141679 | A1 | * | 7/2003 | Hong | 280/11.26 |
| 2006/0006616 | A1 | * | 1/2006 | Sauter et al. | 280/11.221 |
| 2006/0038362 | A1 | * | 2/2006 | Svensson et al. | 280/11.221 |
| 2006/0091621 | A1 | * | 5/2006 | Lin | 280/11.26 |
| 2006/0220332 | A1 | * | 10/2006 | Zeng | 280/11.26 |
| 2009/0045596 | A1 | * | 2/2009 | Boucher | 280/11.223 |
| 2010/0032917 | A1 | * | 2/2010 | Roy et al. | 280/11.221 |
| 2010/0127466 | A1 | * | 5/2010 | Green et al. | 280/11.19 |
| 2011/0115174 | A1 | * | 5/2011 | Green et al. | 280/11.215 |
| 2011/0193303 | A1 | * | 8/2011 | Green | 280/11.26 |

FOREIGN PATENT DOCUMENTS

| | | |
|---|---|---|
| EP | 1112698 | 7/2001 |
| FR | 2520242 | 7/1983 |
| GB | 2416313 | 1/2006 |
| JP | UM58171181 | 11/1983 |
| JP | UM336681 | 4/1991 |
| JP | UM450084 | 4/1992 |
| WO | WO9809691 | 3/1998 |
| WO | 0200313 | 1/2002 |
| WO | WO2004071600 | 8/2004 |
| WO | WO2005021111 | 3/2005 |

* cited by examiner

ROLLER SKATE

RELATED APPLICATIONS

The present application is a continuation-in-part of U.S. patent application Ser. No. 13/608,040 filed on Sep. 10, 2012, which is a continuation-in-part of U.S. patent application Ser. No. 13/066,502 filed on Apr. 15, 2011, now U.S. Pat. No. 8,348,284 issued on Jan. 8, 2013, which in turn is a continuation-in-part of U.S. patent application Ser. No. 12/807,085 filed on Aug. 27, 2010, now U.S. Pat. No. 8,292,308 issued on Oct. 23, 2012, which in turn is a continuation-in-part of U.S. patent application Ser. No. 12/590,877 filed on Nov. 16, 2009, now U.S. Pat. No. 8,251,377 issued on Aug. 28, 2012.

BACKGROUND OF THE INVENTION

The present invention relates to wheeled skates, and more particularly to wheeled skates adaptable to be removably mounted upon a skater's footwear. The invention further relates to wheel trucks for mounting wheels on skates, skateboards, scooters and the like.

Roller skates include wheels attached to the sole portion of a skate shoe. Conventional roller skates have a pair of front wheels sharing one axis of rotation and a pair of rear wheels sharing a second axis of rotation that is parallel to the first set of wheels. Since each wheel is displaced from the longitudinal center axis of the roller skate, conventional four wheeled roller skates provide substantial lateral stability.

Inline roller skates typically have multiple wheels arranged in longitudinal alignment along the center axis of the skate. Each wheel has a unique axis of rotation that is parallel to the axes of rotation of the other wheels. Because each of the wheels are upon the longitudinal axis of the skate, inline skates provide less lateral stability than four wheeled roller skates. However, inline roller skates provide other advantages including being considered faster than conventional skates by providing all of the wheels upon the ground even when the skate is tilted about the skate's longitudinal axis. Furthermore, it is possible to do the so called "hockey-stop" braking action with an inline skate, while this style of braking is not capable of being accomplished with a traditional four wheeled skate.

To provide braking action, wheeled skates will often include a toe stop, also referred to as a toe brake. A toe stop can serve to slow a skater's forward speed when the skater drags the toe of the wheeled skate behind their body upon the skating surface. Further, when the skater is skating backwards, the skater can utilize the toe brake as a brake to slow backward motion. Unfortunately, these actions require that the wheels of the skate be disengaged from the skating surface when the skater raises their foot.

Wheeled skates have also been known to include a rear brake pad. Like the toe brake, the rear brake is activated by a skater raising their skate off the skate surface and leveraging the rear brake against the skate's surface. Utilizing brake pads of either conventional four wheeled skates or inline wheeled skates can be counter productive both from the need to apply substantial forces to the brake pad against the skate surface and to the skater's need to maintain balance, control and maneuverability while braking.

It is also known to provide wheeled skates which are mounted to skater's footwear, and to provide skates which are expendable to affix to footwear of different sizes. U.S. Pat. No. 4,351,538 shows an expandable roller skate with toe and heel plates and toe and instep straps for securing the skate on a skater's shoe. U.S. Pat. No. 1,771,855 shows an expandable strap-on roller skate with wheels positioned in front of the toe plate and in back of the heel plate. U.S. Pat. No. 5,620,190 shows an expandable strap-on skate with front and rear brake pads. U.S. Pat. No. 6,217,039 shows an expandable strap-on skate with buckles for securing the straps. U.S. Pat. No. 5,551,713 shows a skate with a pair of rear wheels and two in-line front wheels and front and rear stops or brakes. U.S. Published Patent Application No. 2003/0116930 discloses a roller skate having a tiltable pair of front wheels and a single rear wheel.

Unfortunately prior art wheeled skates suffer from numerous disadvantages.

Specifically, it would be desirable to provide a wheeled skate which provided greater breaking capacity while maintaining stability.

Furthermore, it would be desirable to provide an improved skate which could be adjusted in length to affix to shoes of various sizes without requiring the use of tools or the use of one's hand for adjustment.

It would also be desirable to provide a wheeled skate which could be affixed to the shoe without buckles or the like.

SUMMARY OF THE INVENTION

The present invention addresses the aforementioned disadvantages by providing an improved roller skate. The roller skate includes a platform for supporting a skater's foot having a toe plate, a heel plate, and a connecting assembly for connecting the toe plate to the heel plate. The connecting assembly is adjustable for providing extension and retraction to allow the platform to adjust to different lengths to accommodate feet of different lengths. The roller skate includes a front wheel truck secured to the underside of the toe plate and a rear wheel truck secured to the underside of the heel plate. The term "wheel truck" is intended to be interpreted broadly. More specifically, the term "truck" is utilized in the field of skateboarding to refer to a metal "T" shaped part that mounts to the underside of a skateboard upon which the wheels are mounted. The traditional skateboard truck includes an axil, a hangar, a kingpin and a bushing which pivots within a metal baseplate. However, "wheel truck" is not intended to be interpreted so literally herein. Instead, unless stated otherwise, the term "wheel truck" is intended to be interpreted to include any mounting structure for mounting one or more wheels to either the toe plate or heel plate of the roller skate's platform.

The roller skate of the present invention includes at least one front wheel rotatably connected in transverse axial alignment on the front wheel truck and at least one rear wheel rotatably mounted in transverse axial alignment on the rear wheel truck. As explained in much greater detail below, the roller skate may take a wide variety of wheel configurations. However, the preferred wheel construction includes a single front wheel affixed to the front wheel truck wherein the front wheel is not capable of a tilting movement about the skate's longitudinal axis. Conversely, the preferred roller skate includes three rear wheels secured to the rear wheel truck where the rear wheel truck provides for tilting movement of the three rear wheels about an at least partially longitudinal axis relative to the roller skate's platform.

The roller skate includes a "biasing means" for biasing the platform's toe plate towards the platform's heel plate so as to be in a retracted condition. Preferably, the biasing means takes the form of one or more helical springs placed tension. However, any known biasing means such as helical springs or rubber bands or the like in the either tension or compression may be utilized for biasing the platform into a retracted condition.

The roller skate of the present invention includes a locking assembly for locking the platform into an extended condition. Preferably, the locking assembly automatically locks the roller skate platform in an extended condition when the toe plate is manually forced away from the heel plate to the farthest extent permitted by the roller skate's connecting assembly. The roller skate further includes a button which projects upward from the top side of either the toe plate or the heel plate so as to engage and be depressed when a skater's foot is placed upon the roller skate's platform. More preferably, the button projects upward from the top side of the heel plate so that the button is not depressed when a skater first inserts their foot into the toe portion of the skate, but the button is depressed when their heel is pushed downwardly upon the platform's heel plate. The button is connected to the locking assembly so that depression of the button causes the locking assembly to unlock the platform from an extended condition to allow the biasing means to force the platform from an extended condition towards a retracted condition.

In a similar embodiment, the button forms the top side of either the toe plate or the heel plate so as to engage and be depressed when a skater's foot is placed upon the roller skate's platform. More preferably, the button projects forms the top side of the heel plate, but is moveable relative to the underlying carriage assembly. In operation, the heel plate top side button is not depressed when a skater first inserts their foot into the toe portion of the skate, but the heel plate top side is depressed when the skater's heel is pushed downwardly upon the platform's heel plate. Again, the button is connected to the locking assembly so that depression of the button causes the locking assembly to unlock the platform from an extended condition to allow the biasing means to force the platform from an extended condition towards a retracted condition.

The extendable and retractable skate platform provides for a novel construction for attaching the skate to a person's shoe. To this end, in a preferred embodiment, the skate includes at least two prongs sized and positioned to project into cavities formed into a person's shoe. Specifically, the preferred roller skate includes a toe prong located at the front of the skate and a heel prong located at the rear of the skate. For purposes of explanation, each prong has a proximal end and a distal end. The proximal end of the toe prong affixes to the front of the toe plate and projects rearwardly so that the distal free end of the toe prong is above the toe plate. Similarly, but in opposite fashion, the proximal end of the heel prong affixes to the back of the heel plate but projects forwardly so that the distal free end of the heel prong is above the heel plate. Because the toe prong and heel prong are located at opposite ends of the skate platform, the distance between the two prongs can be adjusted by extending or retracting the skate platform.

Meanwhile, for a skate embodiment having toe and heel prongs, a specialized shoe is provided. The shoe includes at least one toe cavity and at least one heel cavity. The toe cavity and heel cavity are located in the shoe's sole. The toe cavity is sized and positioned for receiving the toe prong while the heel cavity is sized and positioned for receiving the heel prong when the skate platform is collapsed from an extended position to a retracted position. When in a retracted condition, the shoe is affixed to the skate by the toe and heel prongs projecting into the respective toe cavity and heel cavity.

As explained above, a skate with toe and heel prongs requires a specialized shoe having toe and heel cavities. Unfortunately, a skater may wish to use his skates with more traditional shoes which do not have such cavities. To this end, and in still an additional preferred embodiment, the roller skate includes removable and replaceable toe and heel plates. A first toe and heel plate combination is constructed without prongs, but may include straps or the like for affixing to traditional shoes. Meanwhile, a second toe and heel plate combination is constructed to include prongs for engaging and affixing to specialized shoes having corresponding toe and heel cavities. The toe and heel plates may be removably affixed to the rest of the skate platform using various fasteners known to those skilled in the arts such as threaded fasteners, snap-fit fasteners and the like.

In a preferred embodiment, the rear wheel truck is connected to the heel plate by a one piece "t-bolt". The t-bolt extends downwardly at an inclined angle for providing tilting movement of the rear wheels about an inclined longitudinal axis relative to the platform. Moreover, the t-bolt includes a laterally extending cross-bar for rotatably connecting the t-bolt to the platform. To connect the cross-bar to the platform, the roller skate includes a pivot mount secured to the underside of the heel plate. The pivot mount rotationally receives the t-bolt cross-bar to allow the t-bolt and rear wheel truck to pivot about a transverse axis relative to the platform. Thus, the rear wheels are capable of both rotating about an inclined longitudinal axis relative to the platform by rotating about the t-bolt, and the rear wheels are capable of rotating about a transverse axis relative to the platform as the rear wheel truck can rotate about the t-bolt cross-bar. Preferably, the t-bolt includes an extension arm which extends rearwardly from the cross-bar so as to engage the heel plate upon the platform pivoting rearward a predetermined angle.

Furthermore, the roller skate may include a brake pad positioned above the rear center wheel so as to engage the rear center wheel when the platform is pivoted rearwardly to restrict rotation of the rear center wheel and provide braking for the roller skate. Advantageously, the pivot mount construction and positioning of the brake pad so as to engage the rear center wheel allows the three rear wheels to maintain engagement with the ground even as the roller skate and platform are tilted rearwardly during braking.

Thus, it is an object of the present invention to provide a roller skate which is capable of affixing to a person's shoe.

It is still an additional object of the present invention to provide a roller skate which has an adjustable length and which will automatically lock in an extended condition, but also automatically retract to a refracted condition when a person's foot is simply placed upon the roller skate's platform.

It is still an additional object to the present invention to provide a roller skate having a single front wheel which does not tilt about the skate's longitudinal axis, and three rear wheels which tilt about a partially longitudinal axis.

It is still an additional object of the present invention to provide a roller skate wherein the rear wheels are tiltable about a transverse axis to allow a rear center wheel to engage a brake pad.

DETAILED DESCRIPTION OF THE DRAWINGS

Figure 27:
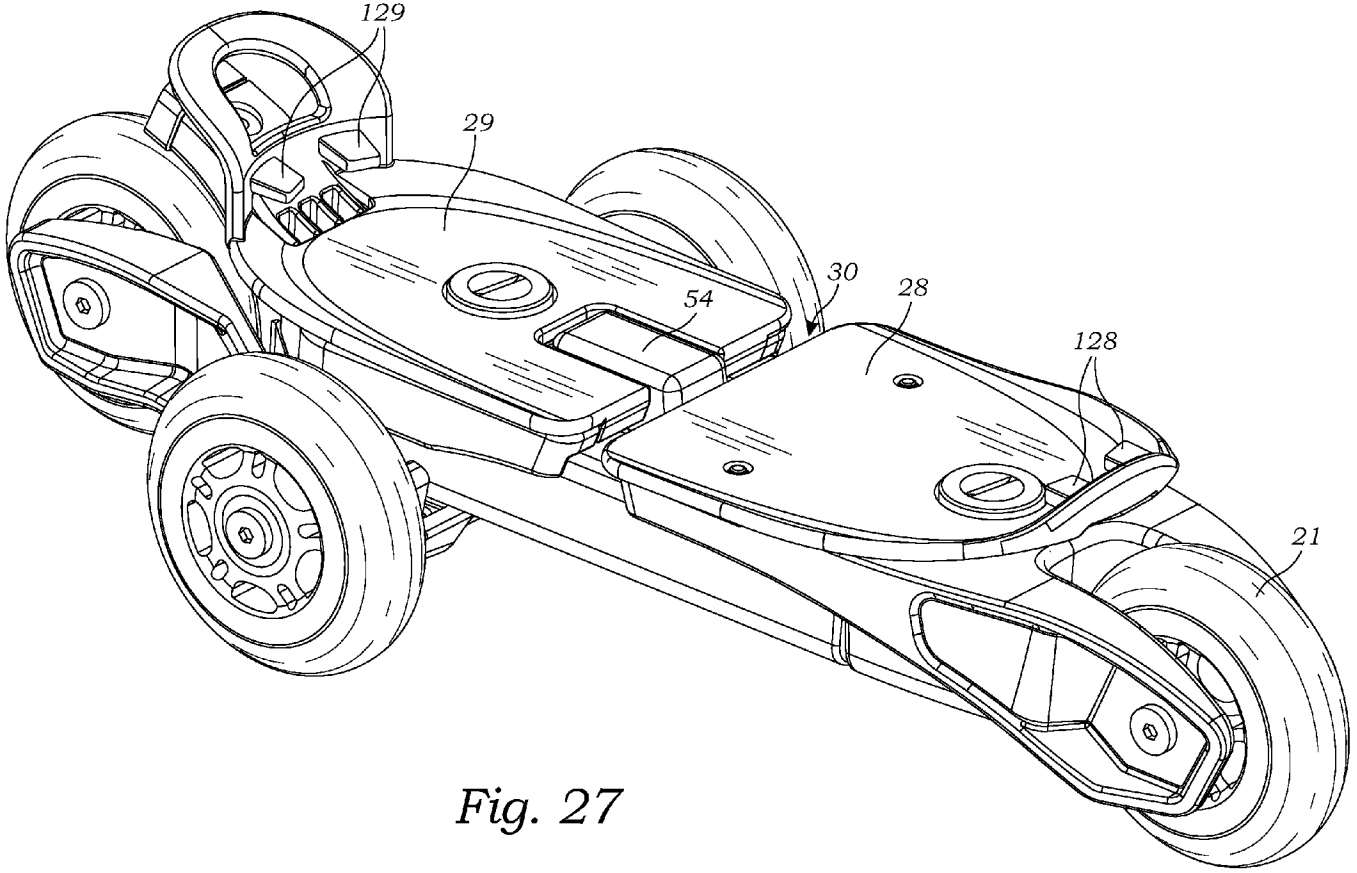
Figure 28:
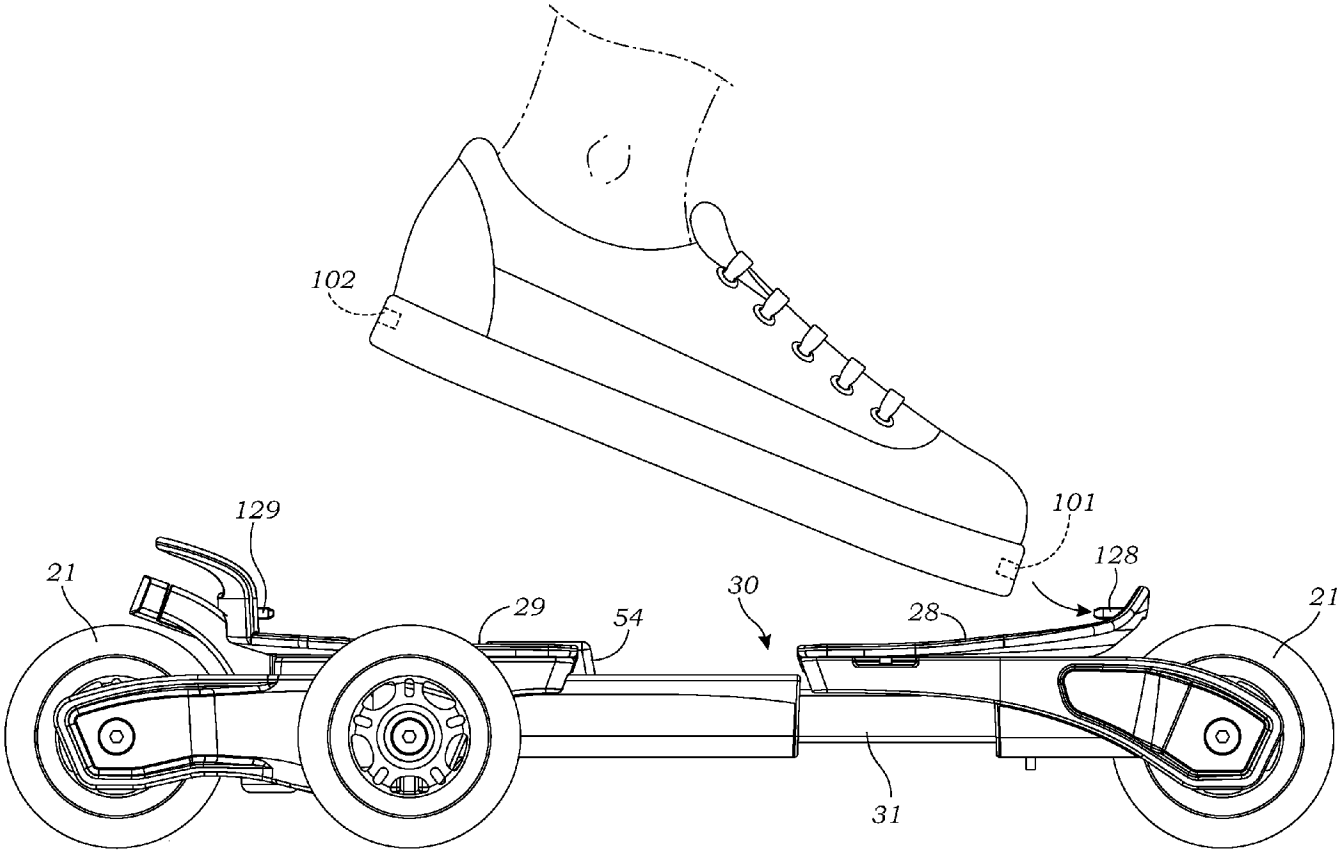
Figure 29:
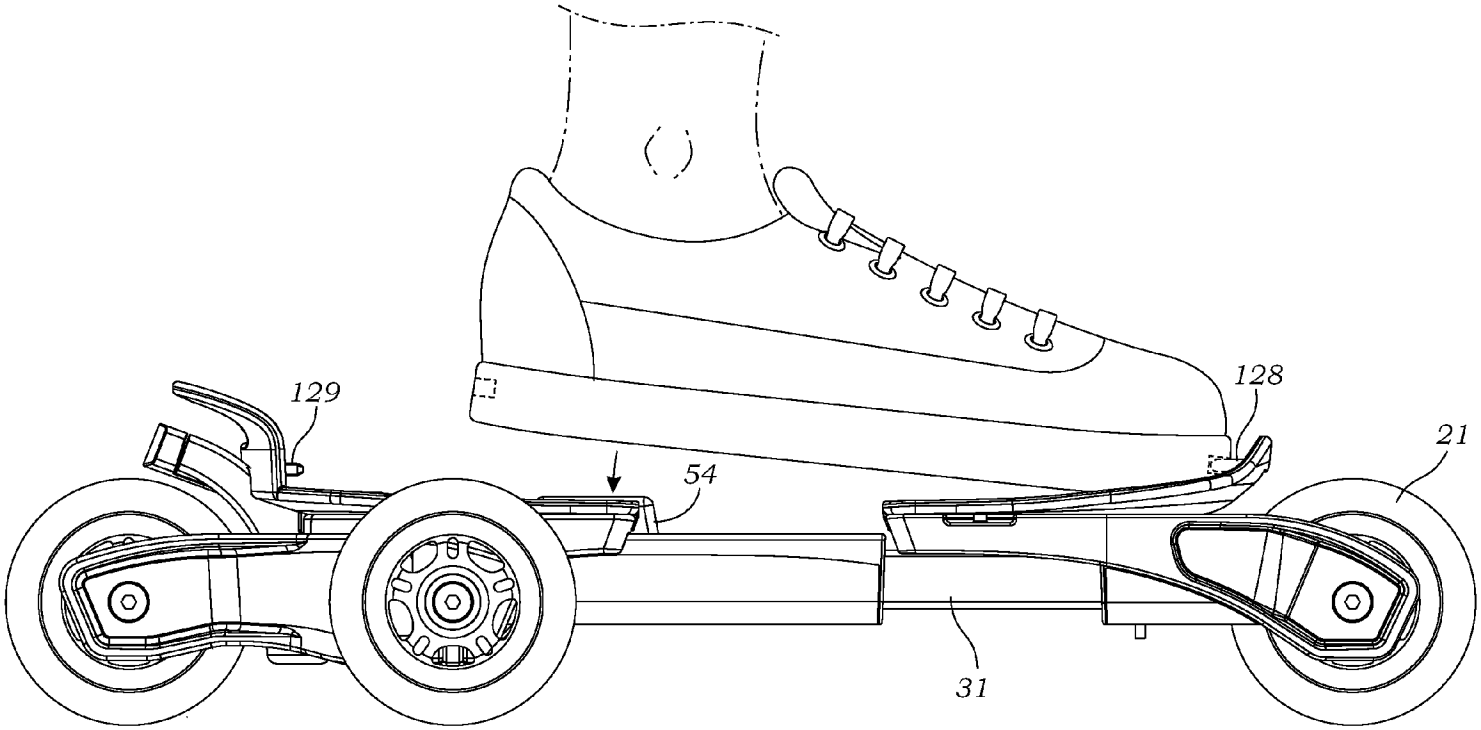
Figure 30:
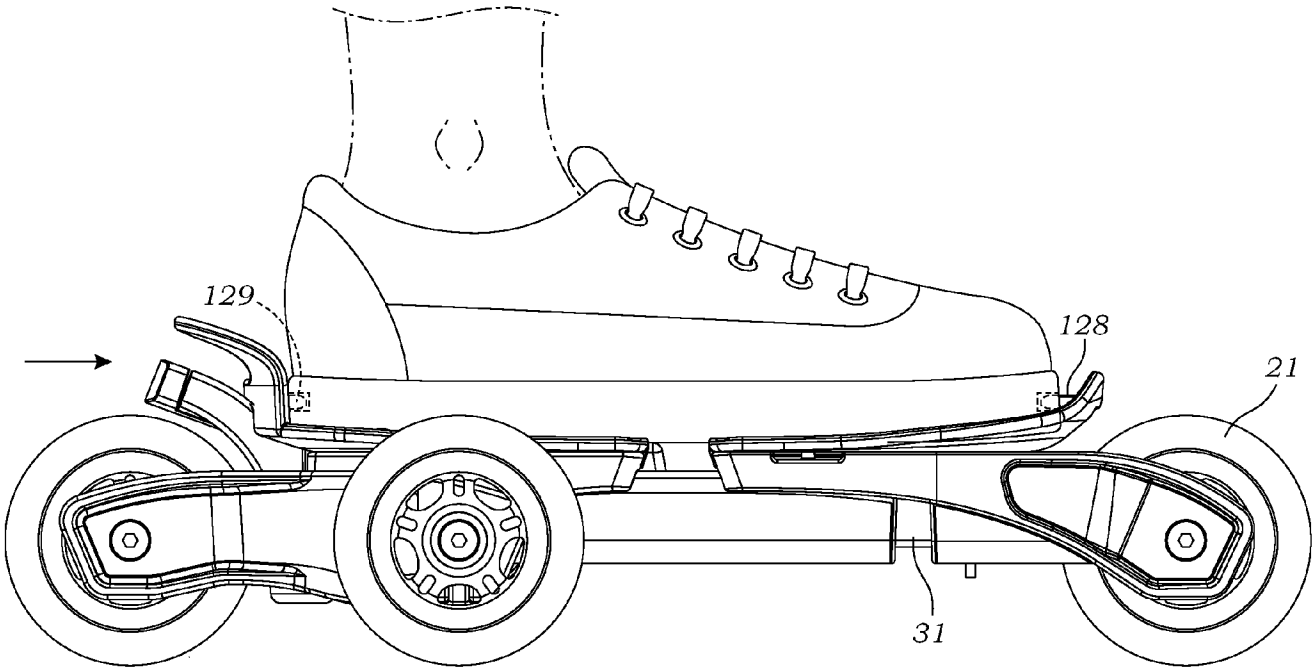
Figure 31:
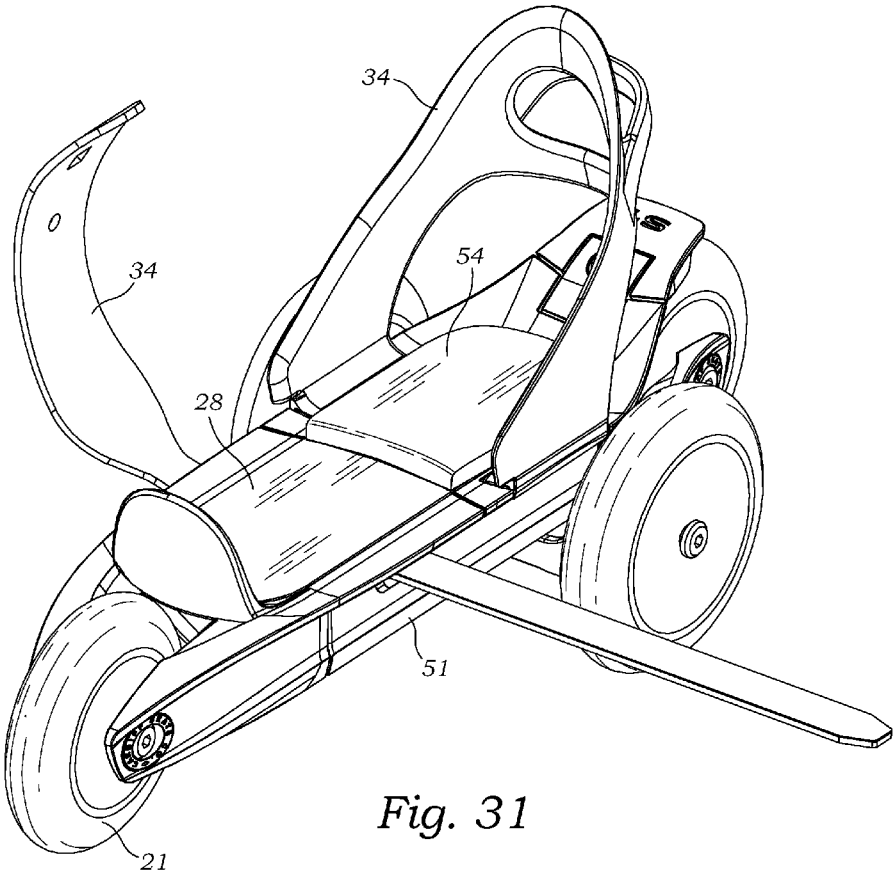
Figure 32:
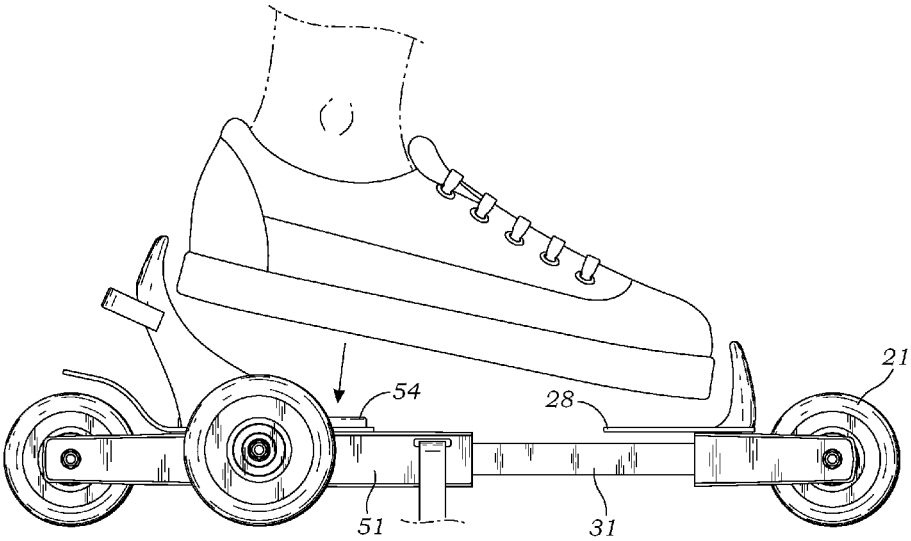
Figure 33:
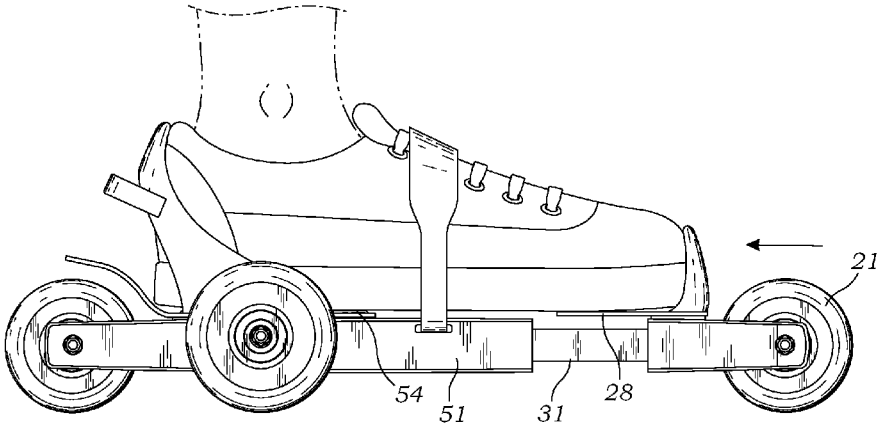
Figure 34:
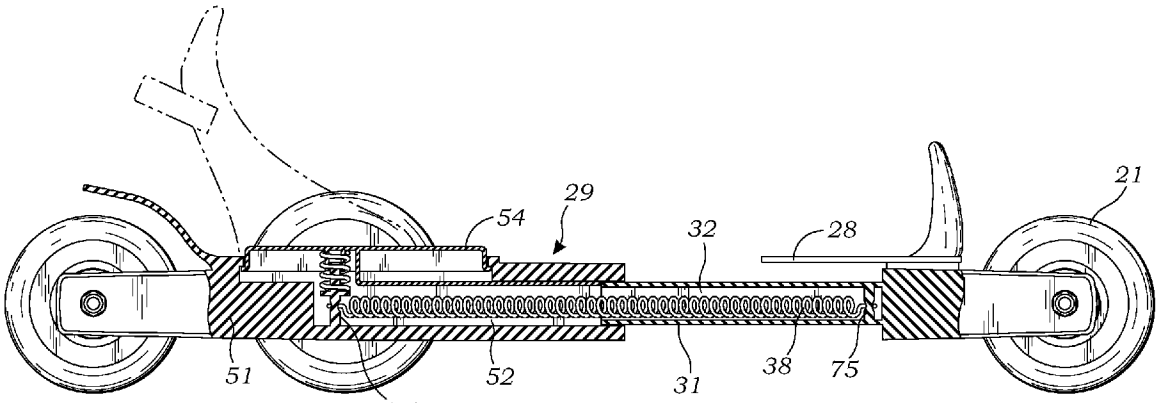
Figure 35:
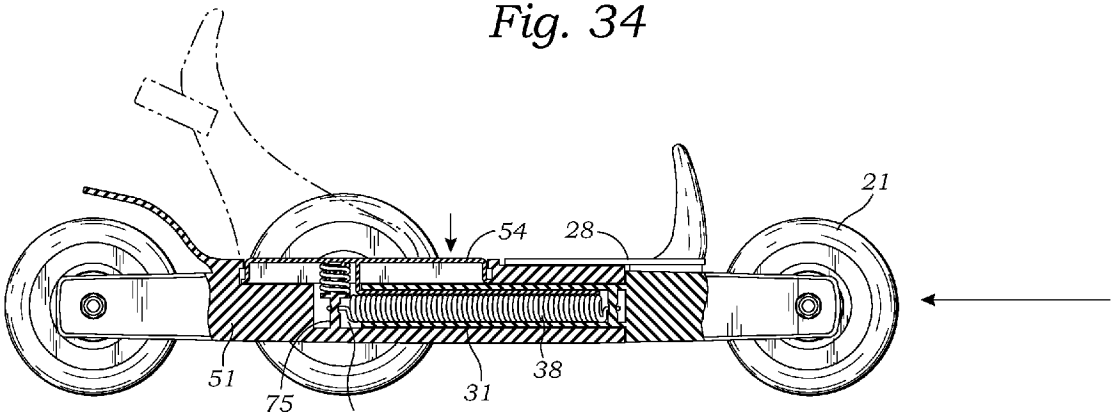

FIG. 27 a front perspective view of the roller skate of the present invention including two toe prongs and two heel prongs for fitting into corresponding cavities of a shoe;

FIG. 28 is a side view of the roller skate of the present invention including a toe prong and heel prong for inserting into cavities in a shoe;

FIG. 29 is a side view of the roller skate of the present invention including a heel prong and toe prong wherein the heel prong is being inserted into a cavity formed in a shoe;

FIG. 30 is a side view of the roller skate of the present invention including a heel prong and a toe prong wherein each prong is being inserted into corresponding cavities in a shoe;

FIG. 31 is a top, front perspective view of an additional preferred roller skate including a single wheel mounted to the front truck and three wheels mounted to the rear truck wherein a button forms the heel plate to control retraction of the heel plate and toe plate;

FIG. 32 is a side view of the roller skate shown in FIG. 31 in an extended condition prior to a skater's foot engaging the roller skate;

FIG. 33 is a side view of the roller skate shown in FIG. 31 in a retracted condition after a skater's foot has engaged the button forming the heel plate to control retraction of the heel plate and toe plate;

FIG. 34 is a side cutaway view of the roller skate shown in FIG. 31 in an extended condition prior to a skater's foot engaging the roller skate; and FIG. 35 is a side cutaway view of the roller skate shown in FIG. 31 in a retracted condition prior.

DETAILED DESCRIPTION OF THE INVENTION

While the present invention is susceptible of embodiment of various forms, as shown in the drawings, hereinafter will be described the presently preferred embodiments of the invention with the understanding that the present disclosure is to be considered as an exemplification of the invention and it is not intended to limit the invention to the specific embodiments illustrated.

With reference to FIGS. 1-23, the present invention is directed to a roller skate 20, and particularly to a roller skate of the type adapted to be strapped onto or removably mounted on a skater's street shoe such as a sneaker, sandal, boot or the like. The roller skate preferably has four wheels 21 arranged in a diamond configuration with a single wheel positioned in the front of the skate and three wheels positioned at the rear of the skate to improve the skater's balance.

This skate includes a longitudinally adjustable platform 26 having a toe plate 28 and a heel plate 29 coupled together by a telescoping connecting assembly 30 which allows the length of the skate platform to be adjusted to fit a skater's foot and shoe. In order to prevent the skater's foot from slipping relative to the toe and heel plates (28 and 29), the upper surface of the plates may include a gripping surface having a high coefficient of friction or may include rows of teeth or barbs to prevent slippage. Further, the roller skate preferably includes a rear panel or cup 32 for engaging the skater's heel so as to prevent it from slipping from the heel plate 29. Also to affix the skater's foot to the roller skate, preferably the roller skate includes one or more straps 34 positioned to wrap over the skater's foot at the skater's toes, instep and/or heel. The skate straps 34 may be adjustable and may be constructed in various configurations known to those skilled in the art particularly in the fields of roller skates, snowboards and snow skis.

The roller skate of the present invention includes a front wheel truck 24 secured to the underside of the toe plate 28 and a rear wheel truck 25 secured to the underside of the heel plate 29. Each of the wheel trucks is provided for securing one or more wheels. As illustrated in FIGS. 1-23, the wheel truck may be constructed rather simplistically in the form of a simple bracket including a pair of arms 76 such as illustrated for holding the front wheel 21. Alternatively, the wheel truck may be constructed in a much more complex manner, such as illustrated for mounting the rear wheels 21, wherein the rear wheel truck 25 provides both tilting and pivoting movement.

The wheels 21 may be constructed of various materials and shapes as can be selected by those skilled in the art. However, preferably the wheels 21 are of the type typically used upon inline skates which are formed of wear resistant polyurethane or other suitable plastic materials affording durability, stiffness and friction upon a skating surface. Inline skate type wheels are preferred because they have a generally oval shaped cross-section which facilitates turning. Though acceptable, wheels from conventional four wheeled roller skates having a flat tread surface would make it more difficult for a skater to execute a turn since they do not facilitate a skater leaning as much into a turn, and thus flat wheels are not considered preferable for the roller skate of the present invention. Nevertheless, where greater stability is desired, such as for children, the roller skates of the present invention may use wider traditional roller skate wheels or "skateboard" type (smaller and wider) wheels to provide the desired greater stability. Also preferable, the wheels include bearings 94 for facilitating wheel rotation.

For the preferred embodiment illustrated in FIGS. 1-23, the roller skate 20 includes a single front wheel 21 rotatably mounted to the front wheel truck 24. Preferably the front wheel 21 is mounted to the front truck 24 by a simple mounting bracket including a pair of arms 76 having holes 78 for receipt of axle screws 96 and an axle bushing ring 98. For this embodiment, the front truck 24 is constructed so as to not provide the front wheel with tilting, or in other words pivotal movement, about the platform's longitudinal axis.

Figure 5:
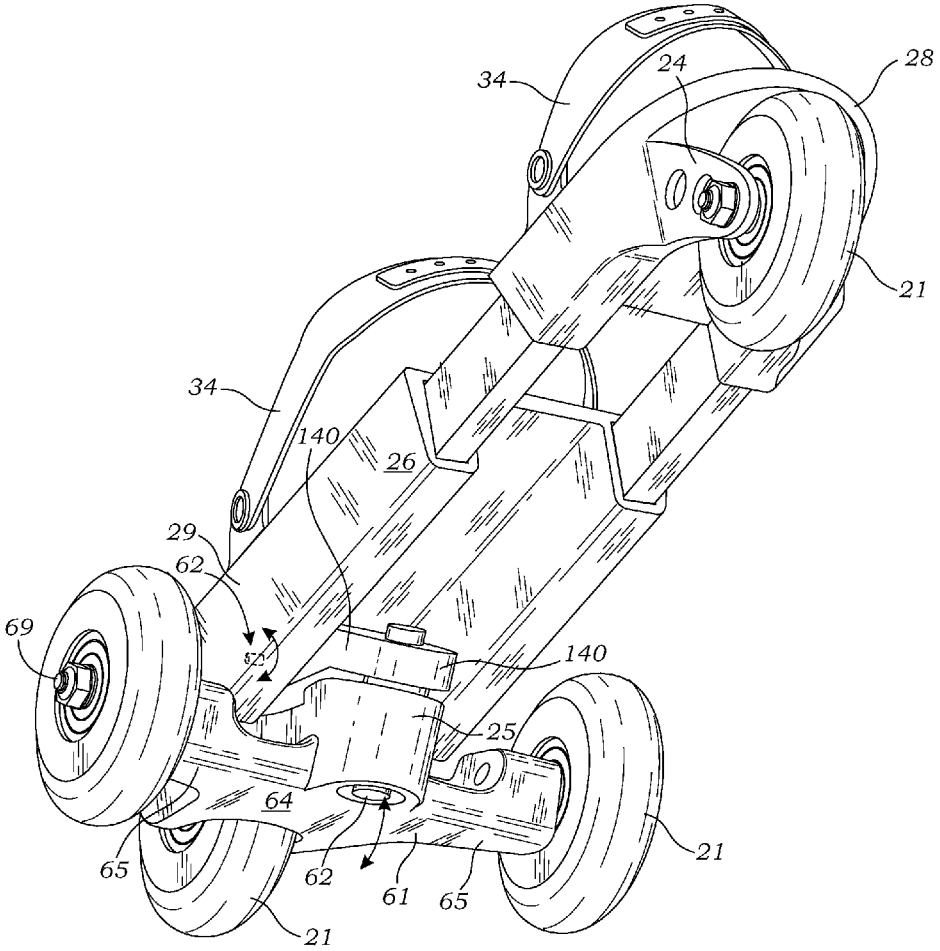
FIG. 5 is a bottom perspective view illustrating the rear truck assembly for the roller skate shown in FIG. 4.
Figure 7:
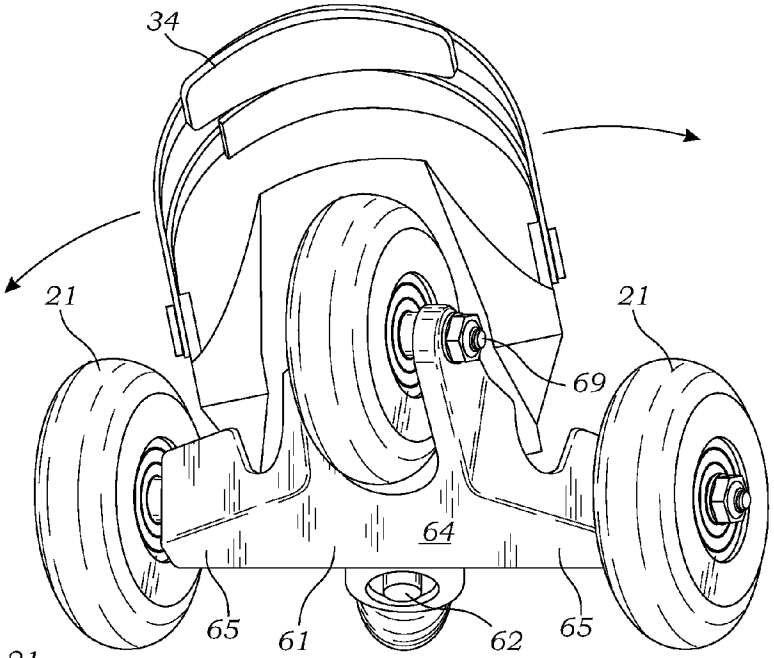
FIG. 7 is a rear elevation view of the roller skate shown in FIG. 6 wherein the rear wheel truck is mounted to the platform for providing tilting movement of the three rear wheels about an inclined longitudinal axis relative to the platform.
Figure 6:
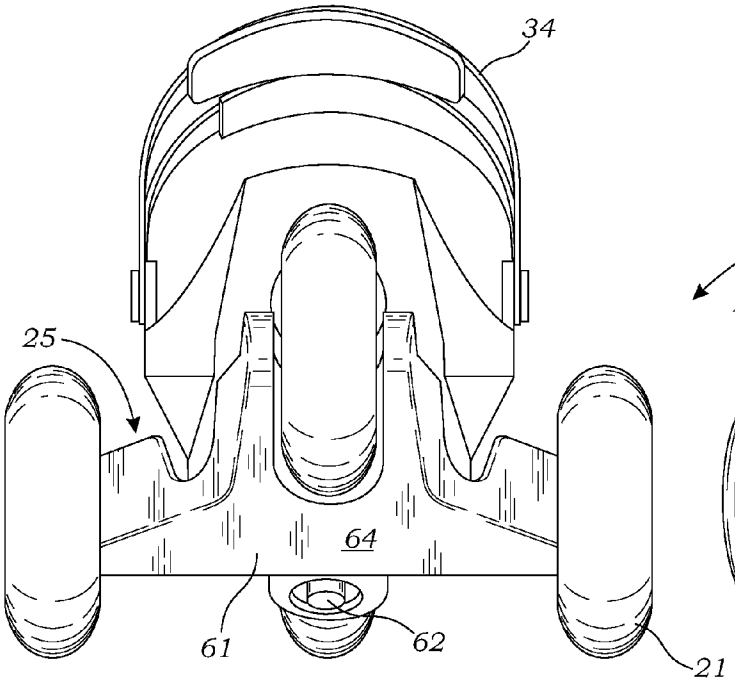
FIG. 6 is a rear elevation view of the roller skate shown in FIGS. 4 and 5.
Figures 8, 9:
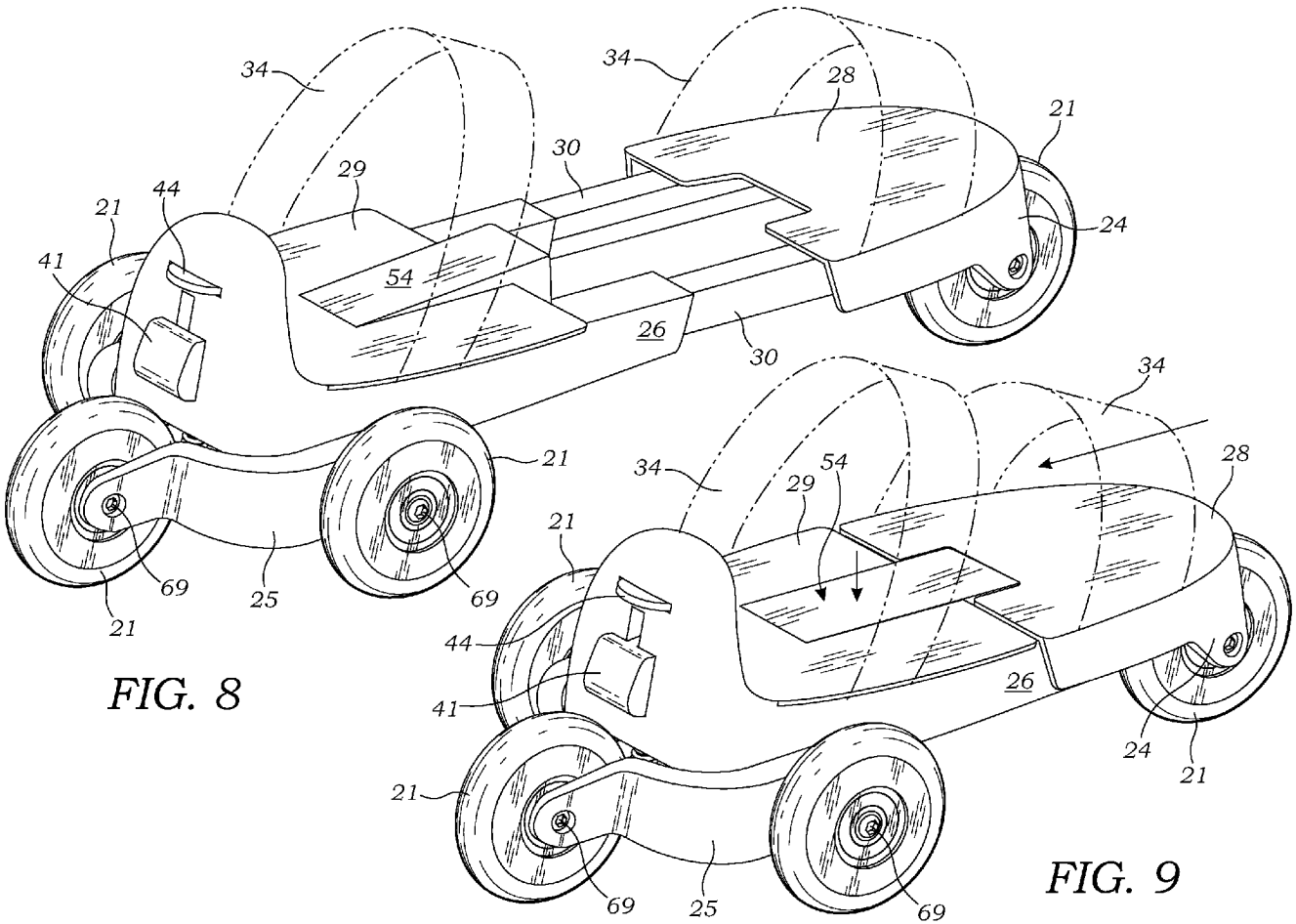
FIG. 8 is a rear perspective view of a preferred roller skate of the present invention in an extended condition having a single wheel mounted to the front truck and three wheels mounted to the rear truck, and further including a button projecting from the top side of a heel plate for unlocking the platform from an extended condition.
FIG. 9 is a rear perspective view of the roller skate illustrated in FIG. 8 in a retracted condition.
Figure 10:
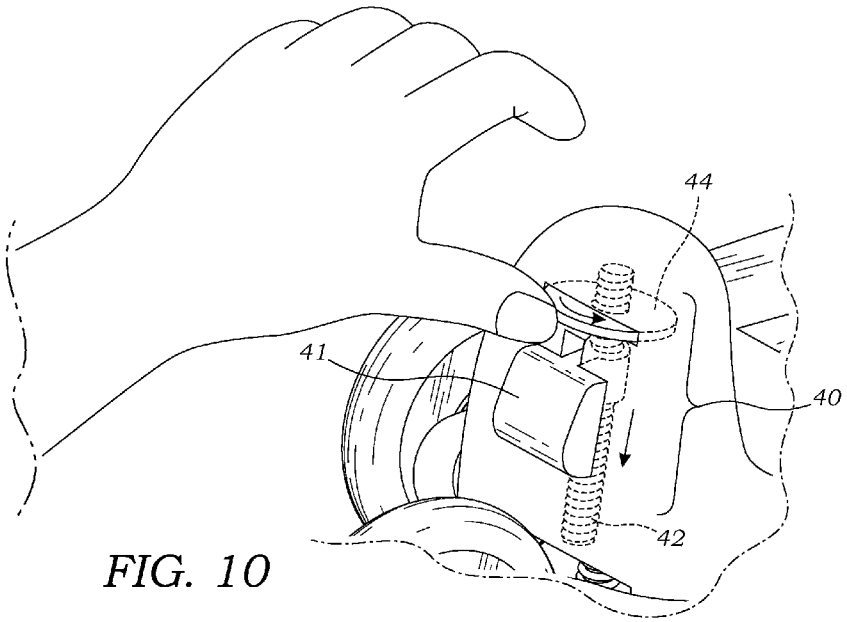
FIG. 10 is a rear perspective view of the rear of a roller skate of the present invention illustrating rotation of a knob for adjusting a rear brake.
Figure 11:
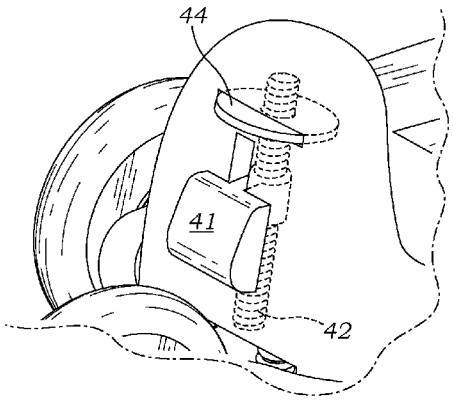
FIG. 11 is a rear perspective view of the roller skate shown in FIG. 10 where the rear brake has been moved downwardly.
Figure 12:
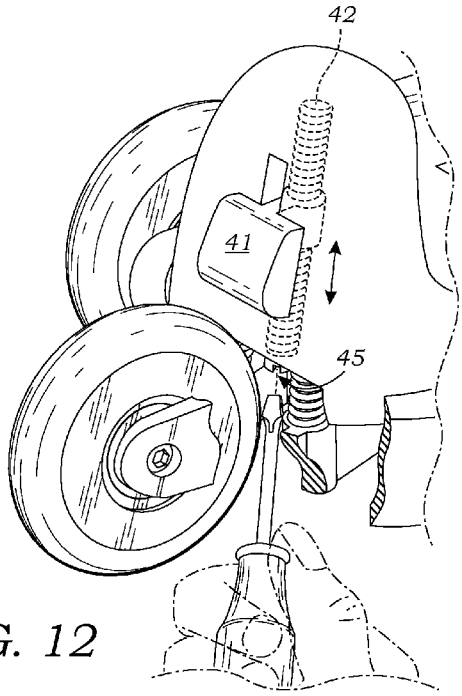
FIG. 12 is a rear perspective view of the roller skate of the present invention wherein a threaded screw, rotatable by a traditional screwdriver, is utilized for positioning the rear brake.

For the embodiment illustrated in FIGS. 1-7, the roller skate 20 includes three rear wheels 21 rotatably mounted to the rear wheel truck 25. The three rear wheels include a pair of parallel wheels 21 and a center wheel 21 positioned rearward of the pair of parallel wheels. The three rear wheels 21 are mounted on the rear truck by a wheel axle yoke 61 similar to that described above for permitting swinging or tilting movement of the rear wheels 21 about an inclined longitudinal axis relative to the skate's platform 26. The wheel axle yoke 61 is again formed to include side arms 65 extending from a central web 64. The side arms 65 include holes through which axle screws 69 extend for rotatably mounting the wheels 21. With reference to FIGS. 5-7, in turn, the yoke 61 is affixed to a mounting plate 140 by a pivot bolt 62. The pivot bolt 62 defines an axis that is inclined at an acute angle downwardly and rearwardly with respect to the horizontal plane of the skate's platform. The incline axis enables the rear wheels to tilt and turn when the skater leans one way or the other. Preferably, the rear wheel truck is constructed so as to place the pair of side-by-side parallel wheels below the skater's heel while the third central wheel is positioned rearward of the skater's heel.

Figure 1:
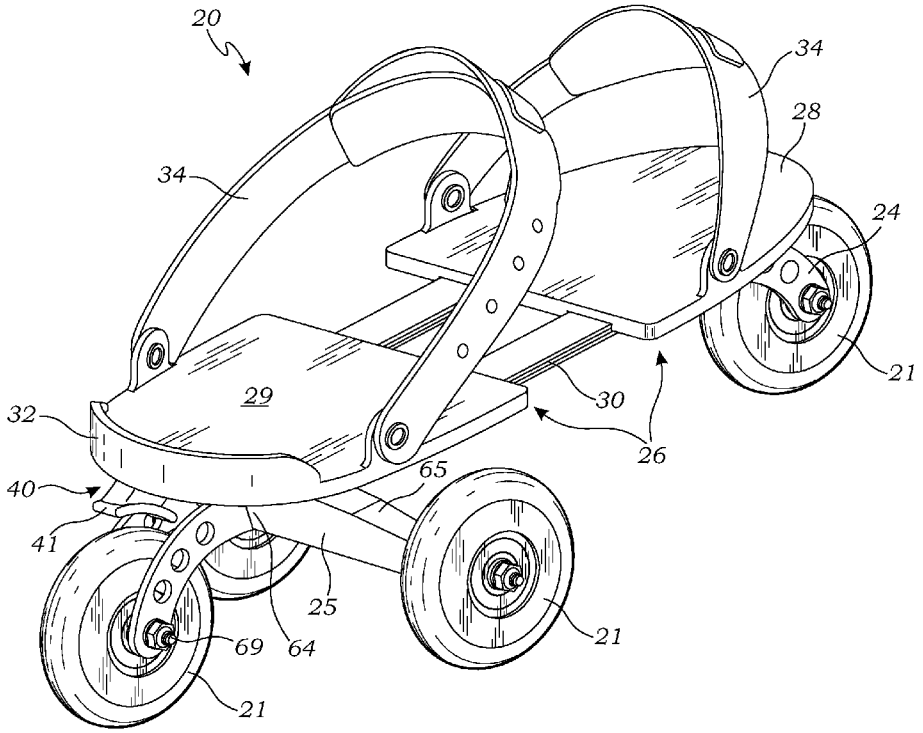
FIG. 1 is a rear perspective view of a preferred roller skate including a single wheel mounted to the front truck and three wheels mounted to the rear truck.
Figure 2:
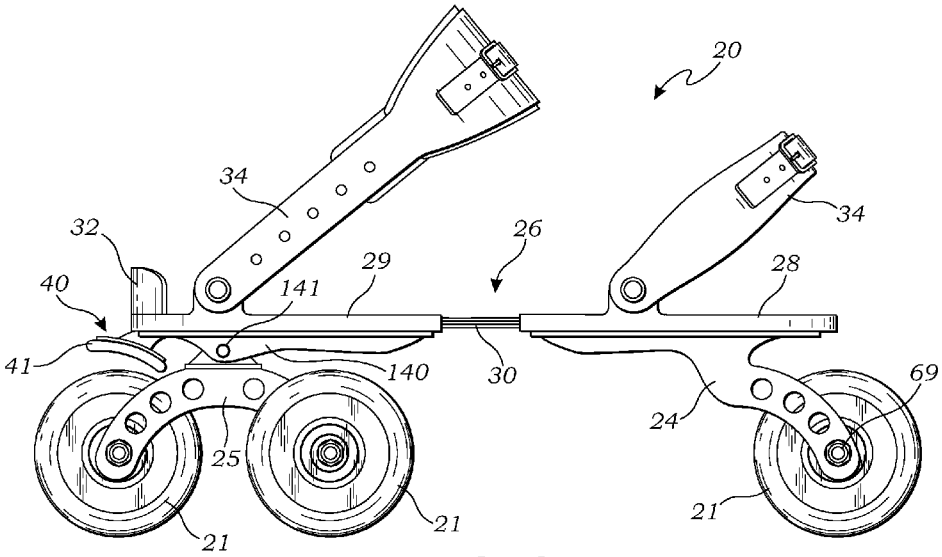
FIG. 2 is a side view of the roller skate illustrated in FIG. 1.
Figure 3:
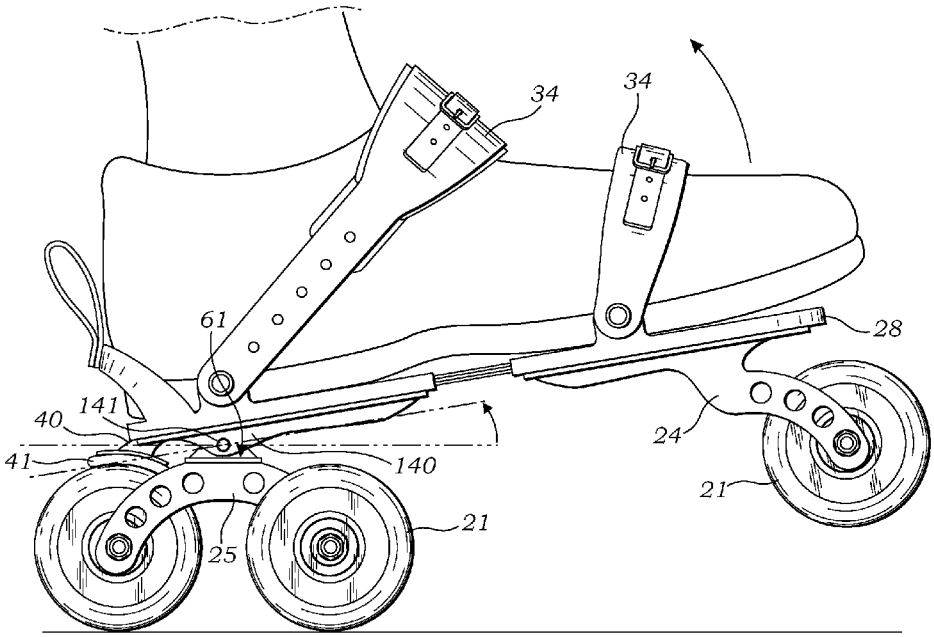
FIG. 3 is a side view of the roller skate shown in FIGS. 1 and 2 wherein the platform is tilted rearwardly relative to the rear wheels.
Figure 4:
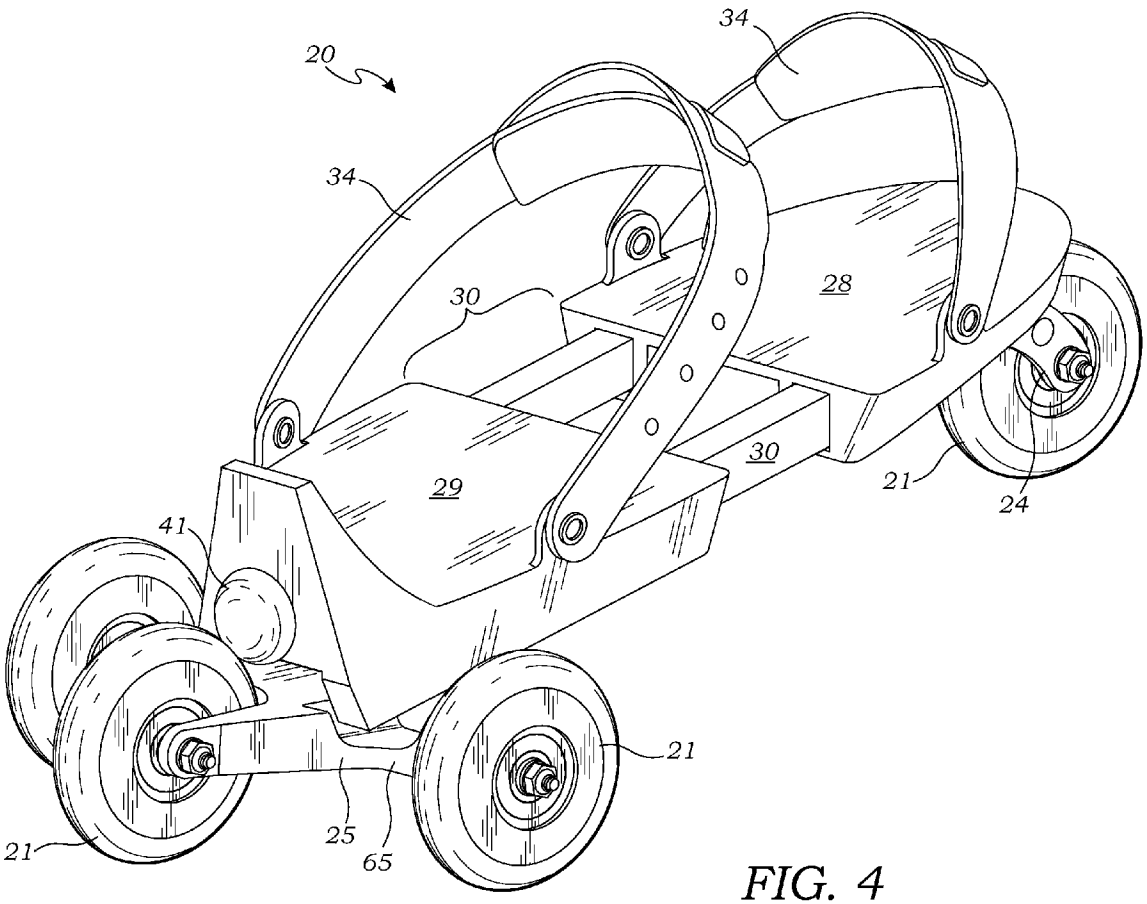
FIG. 4 is a perspective view illustrating an additional embodiment of a roller skate including a single wheel mounted to the skate's front truck and three wheels mounted to the skate's rear truck.

As illustrated in FIGS. 1-23, a preferred embodiment of the roller skate 20 includes a pivot mount 140 for mounting the rear wheel truck 25 to the heel plate 29. The pivot mount 140 allows the rear truck 25 and corresponding three rear wheels 21 to pivot about a transverse axis defined by pivot pin 141. As illustrated in FIGS. 2, 3 and 5, the pivot mount 140 allows a skater to tilt their foot rearwardly so as to maintain the rear wheels on the ground while lifting the front wheel from the ground. Preferably, the skate includes a rear brake 40. The rear brake 40 includes a bracket projecting from the rear of the heel plate 29 and a brake pad 41. The brake pad 41 is positioned so as to selectively engage and disengage as the skater's heel is tilted rearwardly and forwardly, respectively. Advantageously, this embodiment allows the skater to maintain the three rear wheels upon the ground even during braking.

Figure 15:
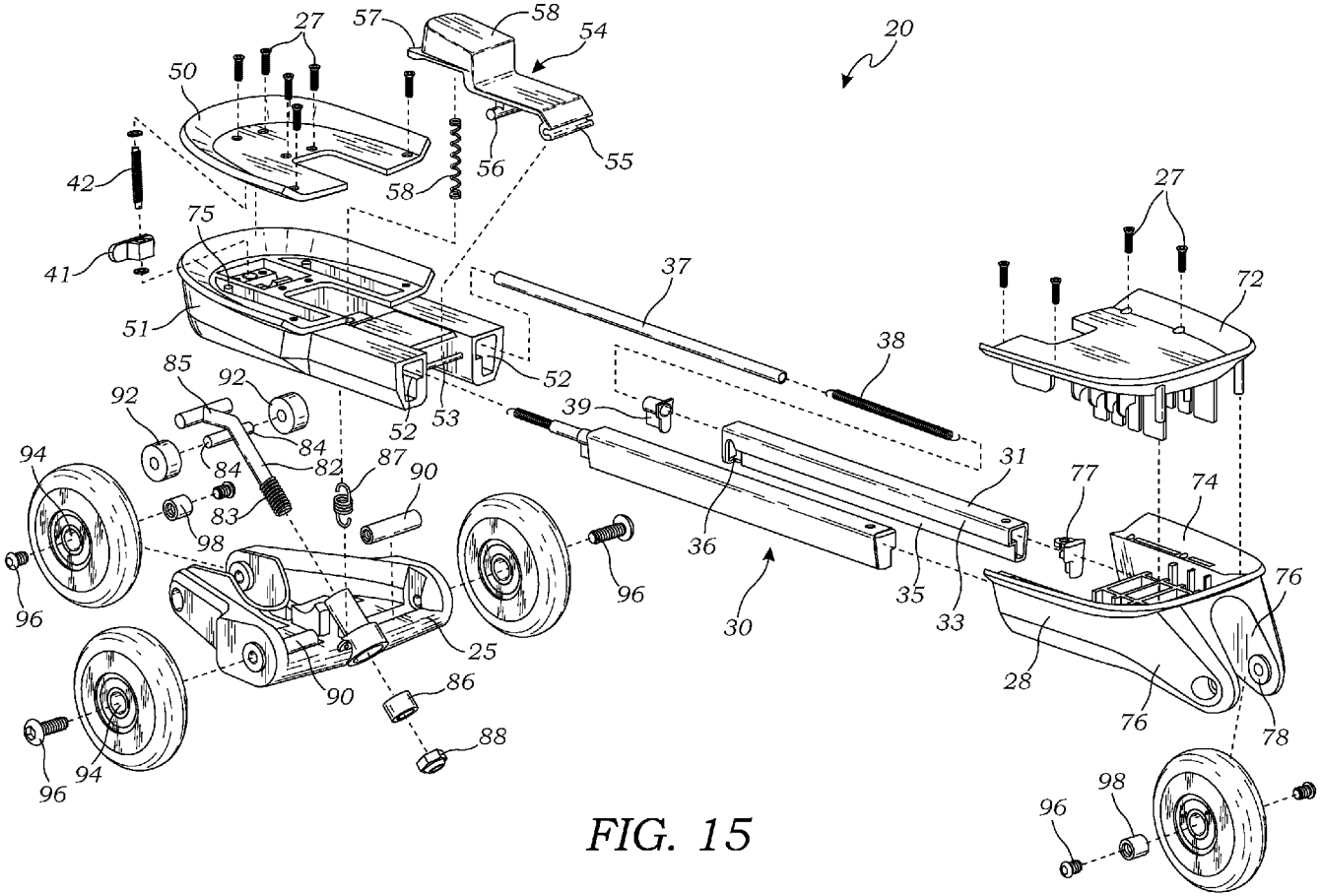
FIG. 15 is a front exploded perspective view of the roller skate of the present invention.
Figure 16:
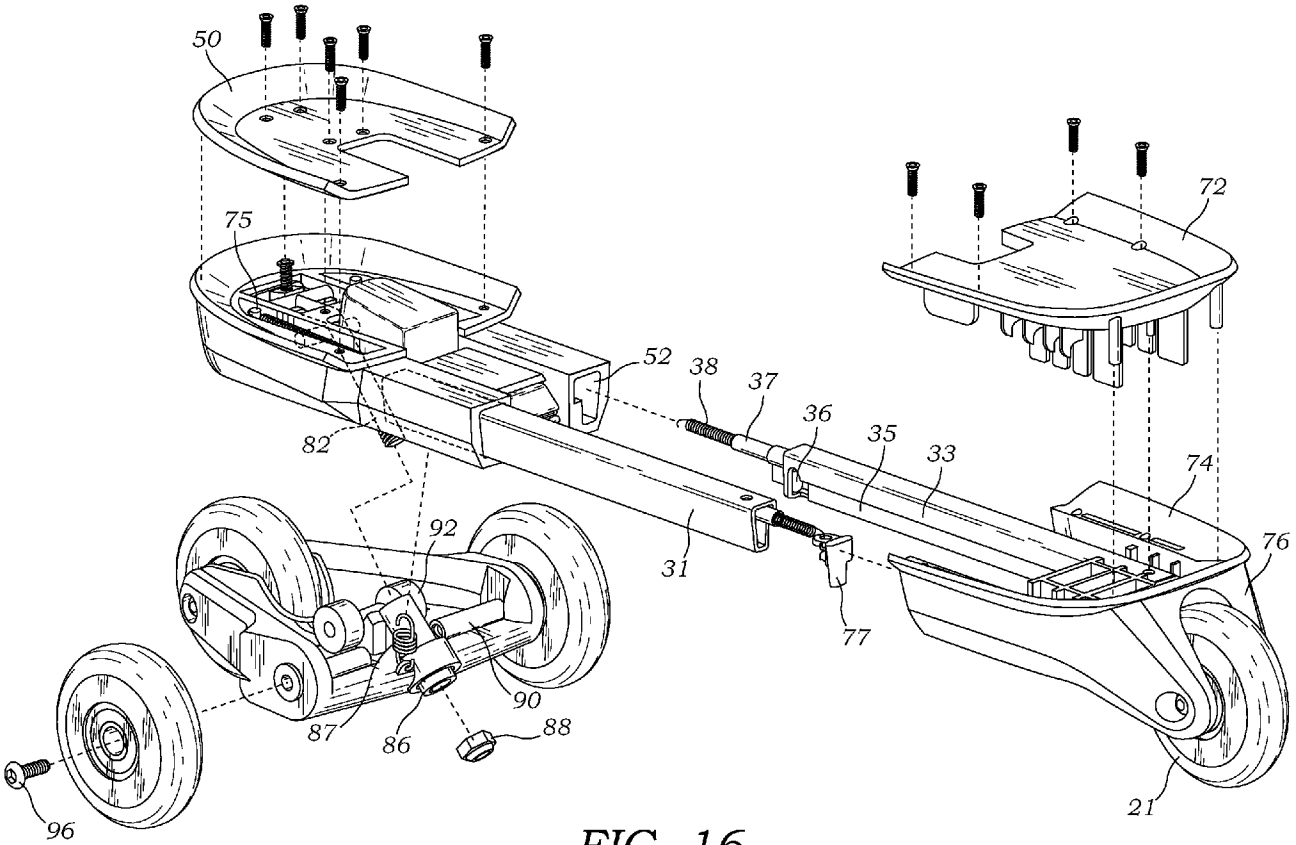
FIG. 16 is an additional front exploded perspective view of the roller skate of the present invention.
Figure 17:
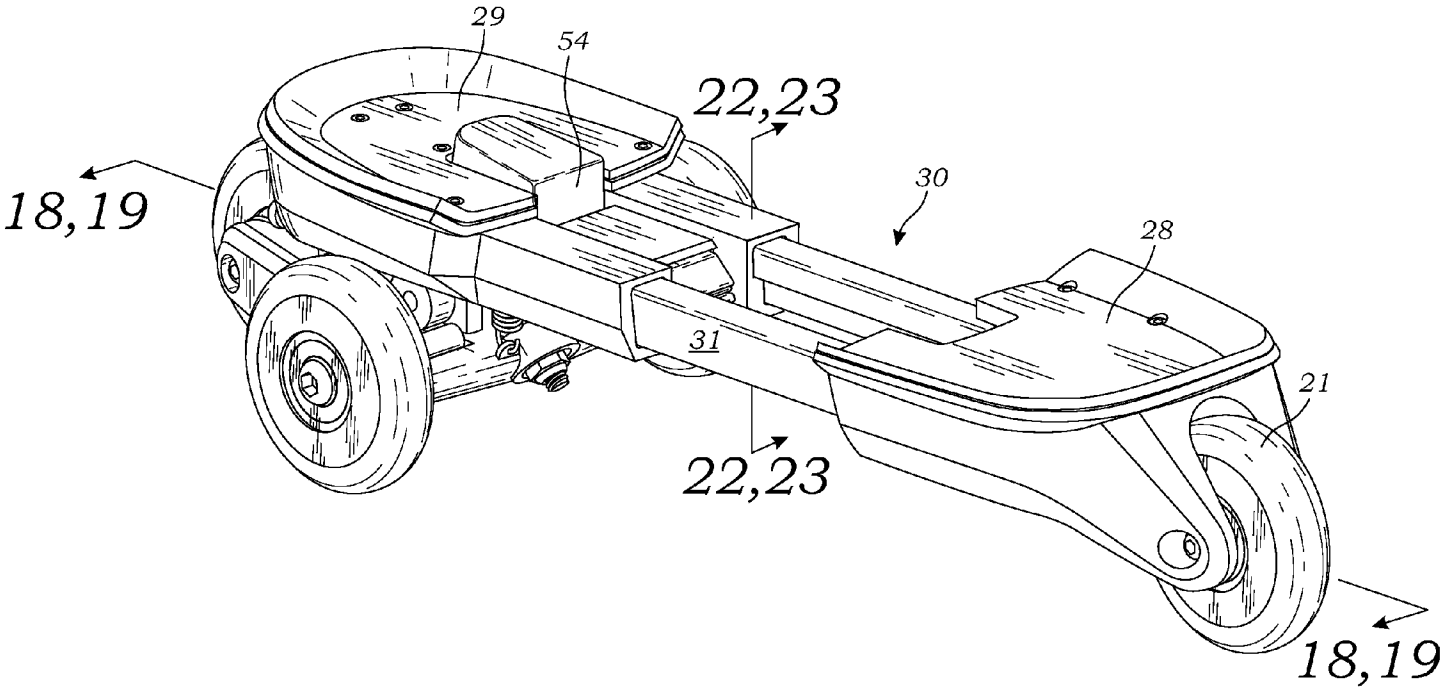
FIG. 17 is a front perspective view of the roller skate in an extended condition.
Figure 22:
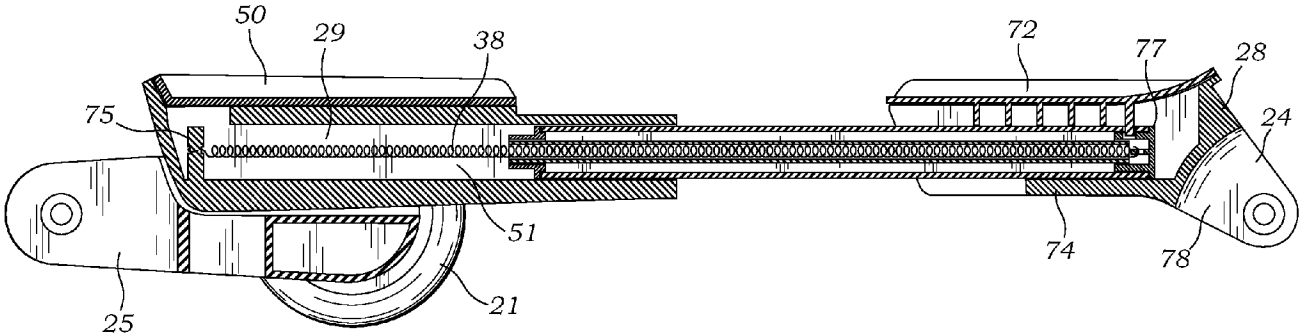
FIG. 22 is a side cutaway view of the roller skate's platform in an extended condition.
Figure 23:
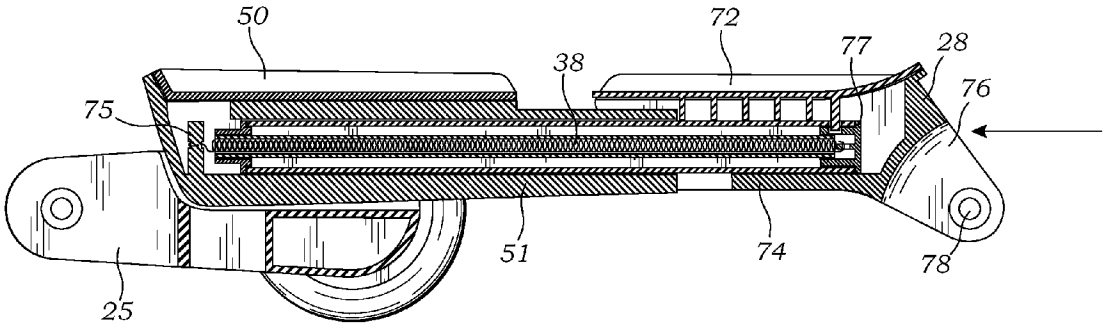
FIG. 23 is a side cutaway view of the roller skate platform in a retracted condition.
Figure 24:
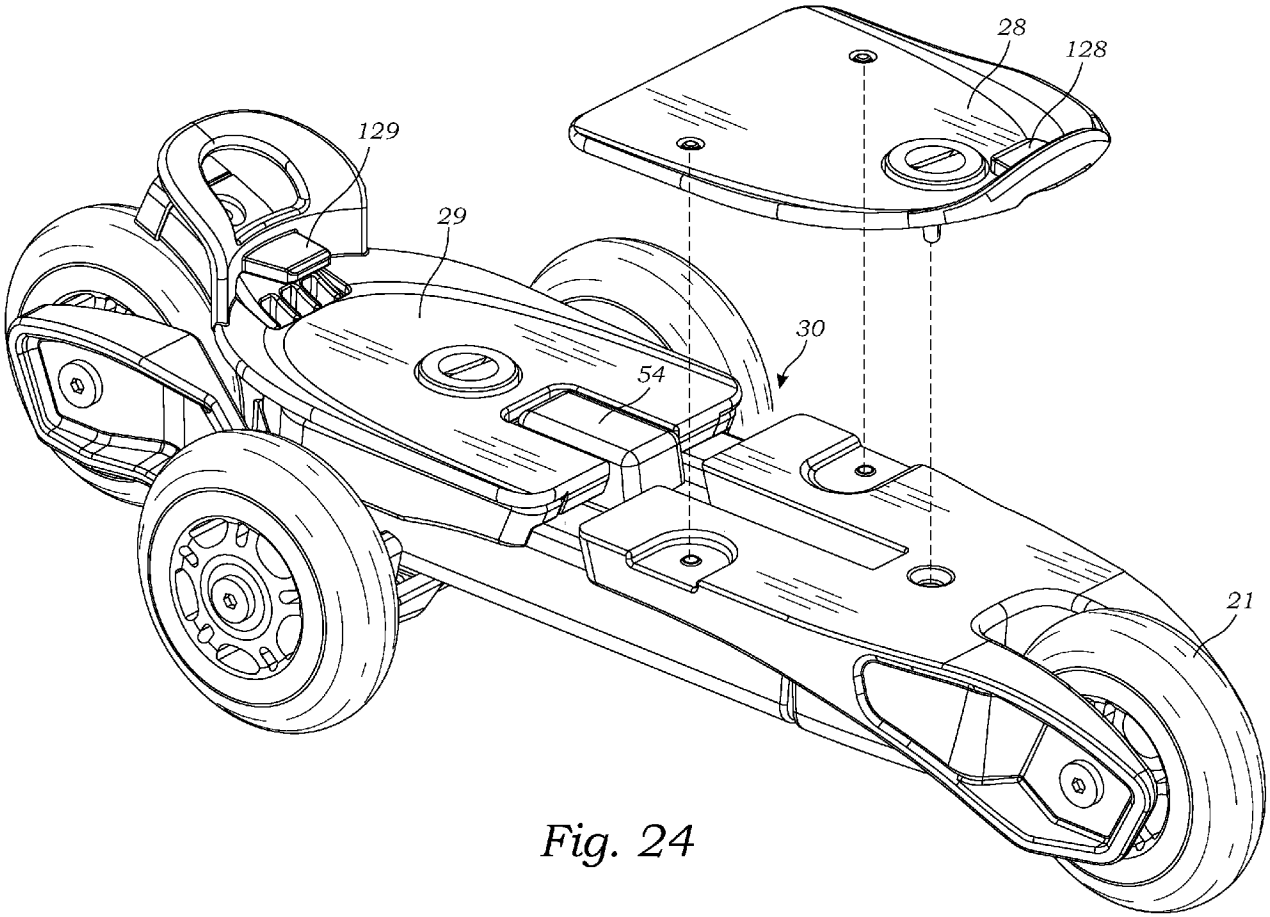
FIG. 24 is a front perspective view of the roller skate of the present invention including a toe prong and a heel prong for projecting into cavities formed within a shoe.
Figure 25:
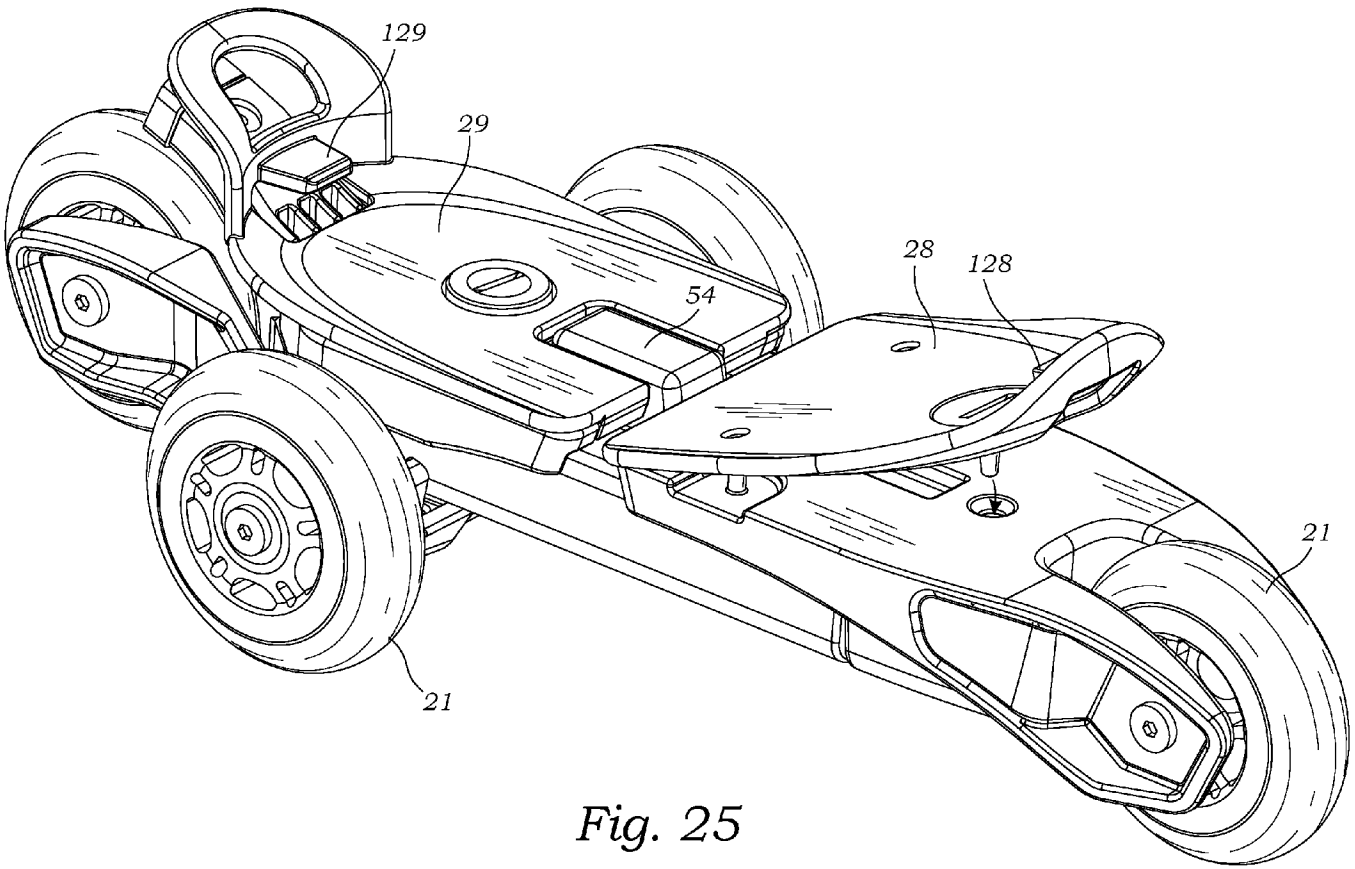
FIG. 25 is a front perspective view of the roller skate of the present invention including a toe prong and a heel prong for projecting into cavities formed within a shoe wherein a front toe plate is being affixed.
Figure 26:
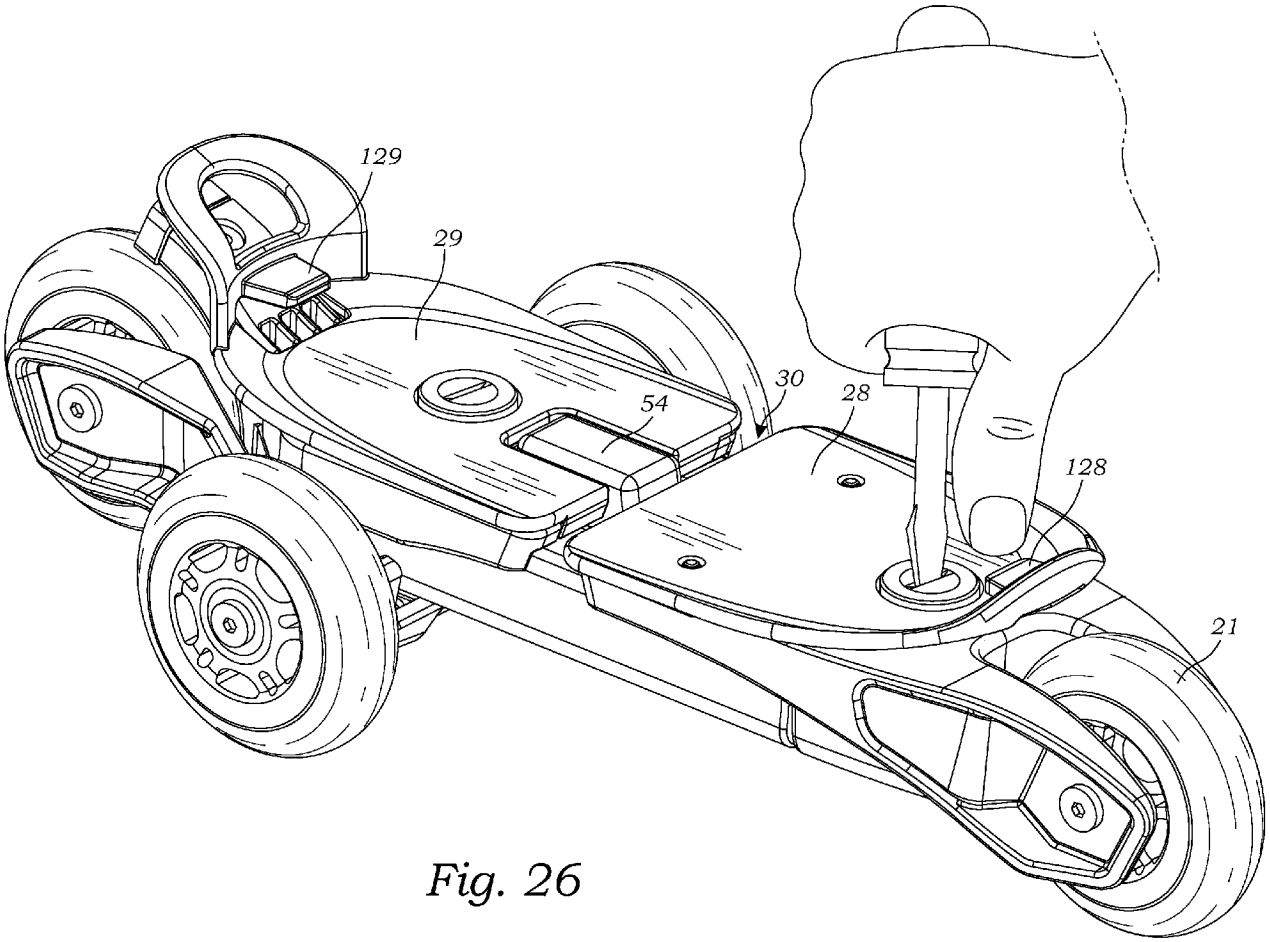
FIG. 26 is a front perspective view of the roller skate of the present invention including a toe prong and a heel prong for projecting into cavities formed within a shoe wherein a front toe plate is being affixed utilizing a standard screw driver.

FIGS. 8-35 illustrate additional preferred embodiments of the roller skate of the present invention including a button 54 for controlling extension and retraction of the roller skate length. Though the button 54 may project upwardly from the top side of either the toe plate 28 or heel plate 29, as illustrated in the figures, the preferred roller skate includes a button which projects upwardly from the heel plate. With reference to FIGS. 13-23, a preferred skate includes a connecting assembly 30 including a pair of hollow rods 31. The hollow rods have an interior 32, and a ridge 33 that forms a slot 35. At the rear end of the slot 35 is a locking notch 36. The connecting assembly further includes one or more springs 38 in tension which affix at their extremities to the toe plate 28 and heel plate 29. As illustrated in FIGS. 15, 22 and 23, the springs may affix to a pin 75, such as located in the heel plate, or may affix to a clip 77, such as utilized in the toe plate. Though not necessary, the connecting assembly 30 may include a tube 37 within which a spring resides to facilitate the spring stretching and compressing without interference. Further, the connecting assembly 30 may include a bushing 39 for positioning the tube 37 and interior spring 38. The hollow rods 31 are affixed to the toe plate 28 by screws of the like. However, the hollow rods are not affixed to the heel plate 29. Instead, the hollow rods 31 telescopically slide within bores 52 formed into the front end of the heel plate 29. Moreover, preferably the two plate 28 in constructed of two pieces including a toe plate upper 72 and a toe plate base 74 for facilitating the assembly and engagement of the connecting assembly 30 to the toe plate 28.

With reference to FIG. 15, a preferred button 54 includes a top surface 59 for depression by a person's heel. The button further includes a recess 55 for rotating about a laterally extending bar 53 affixed to the heel plate 29. To allow insertion of the button 54 into the heel plate 29 during assembly, preferably the heel plate is comprised of two portions including a heel plate upper 50 and a heel plate base 51. As illustrated in the figures, the heel plate upper may be affixed to the heel plate base utilizing traditional screws 27 or the like. The button is preferably biased upwardly by a compression spring 58. However, upward movement and inadvertent removal of the button is prevented by the button including an edge 57 which projects under the heel plate upper 50. Finally, the button includes a pair of locking tabs 56 which extend laterally from the sides of the button 54.

Figure 18:
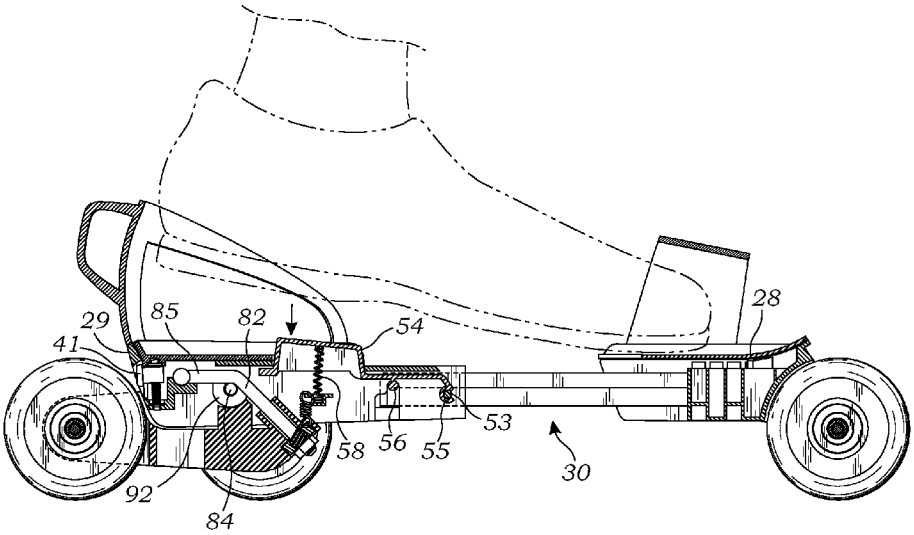
FIG. 18 is a side elevation view of the roller skate in an extended condition allowing entry of a skater's shoe.
Figure 19:
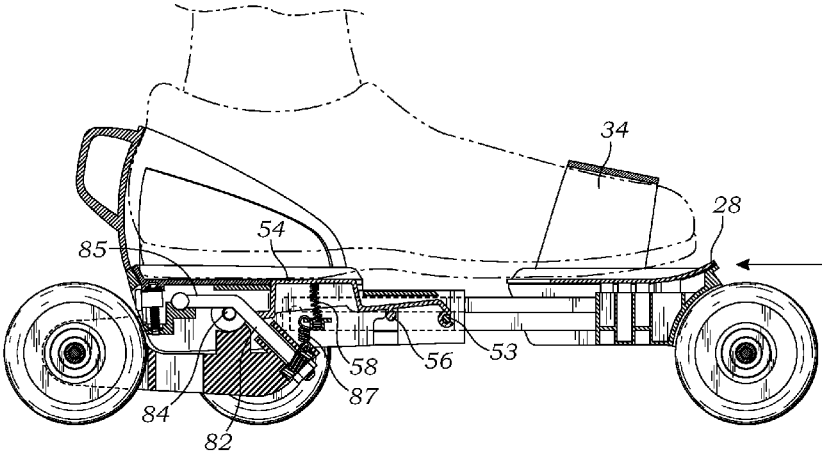
FIG. 19 is a side elevation view of the roller skate of the present invention as the skate proceeds into a retracted condition for capturing a skater's foot.

As illustrated in FIGS. 15-19 and 22-23, the button is positioned so that the button locking tabs 56 reside within the connecting assembly's hollow rod slots 35 so as to not inhibit movement of the hollow rods 31 as they slide within the bores 52 formed within the heel plate 29. However, as the hollow rods 31 are telescopically extended, the limit of such extension is reached when the button tabs 56 reach the rod locking notches 36. Thereafter, the locking tabs 56 are forced upwardly by the compression spring 58 so as to be locked within the locking notch 36, thereby preventing the skate 20 from being extended further, or compressed until the button 54 is depressed. Upon depression of the button 54, the button tabs 56 are rotated downwardly around the bar 53 so as to exit the locking notch 36. Upon the button tabs 56 exiting the locking notch, tensional forces exerted by the springs 38 cause the skate platform to retract, as illustrated in FIGS. 18 and 19.

In an additional preferred embodiment illustrated in FIGS. 31-35, an alternative preferred button 54 forms the top surface of the heel plate for depression by a person's heel. Accordingly, as viewed by the skater, the button is not a separate component of the heel plate, but instead the button 54 is a vertically moveable component upon which the skater places their heel and which provides support for the skater's heel during skating. For this embodiment, preferably the heel plate is comprised of two portions including a heel plate button 54 and a heel plate base 51. The heel plate button 54 is preferably biased upwardly by a compression spring 58.

Like the previous embodiment, the preferred skate includes a connecting assembly 30 including a pair of hollow rods 31. The hollow rods 31 have an interior 32, and one or more springs 38 in tension which affix at their extremities to the toe plate 28 and heel plate 29. As illustrated in FIGS. 34 and 35, the springs 38 may affix to pins 75 located in the heel plate and in the toe plate. The hollow rods 31 are affixed to the toe plate 28 by screws of the like. However, the hollow rods are not affixed to the heel plate 29. Instead, the hollow rods 31 telescopically slide within bores 52 formed into the front end of the heel plate 29. As illustrated in FIGS. 33 and 35, upon depression of the heel plate button 54, the mechanism locking the skate in an extended condition is unlocked, and tensional forces exerted by the springs 38 cause the skate platform to retract.

Figure 13:
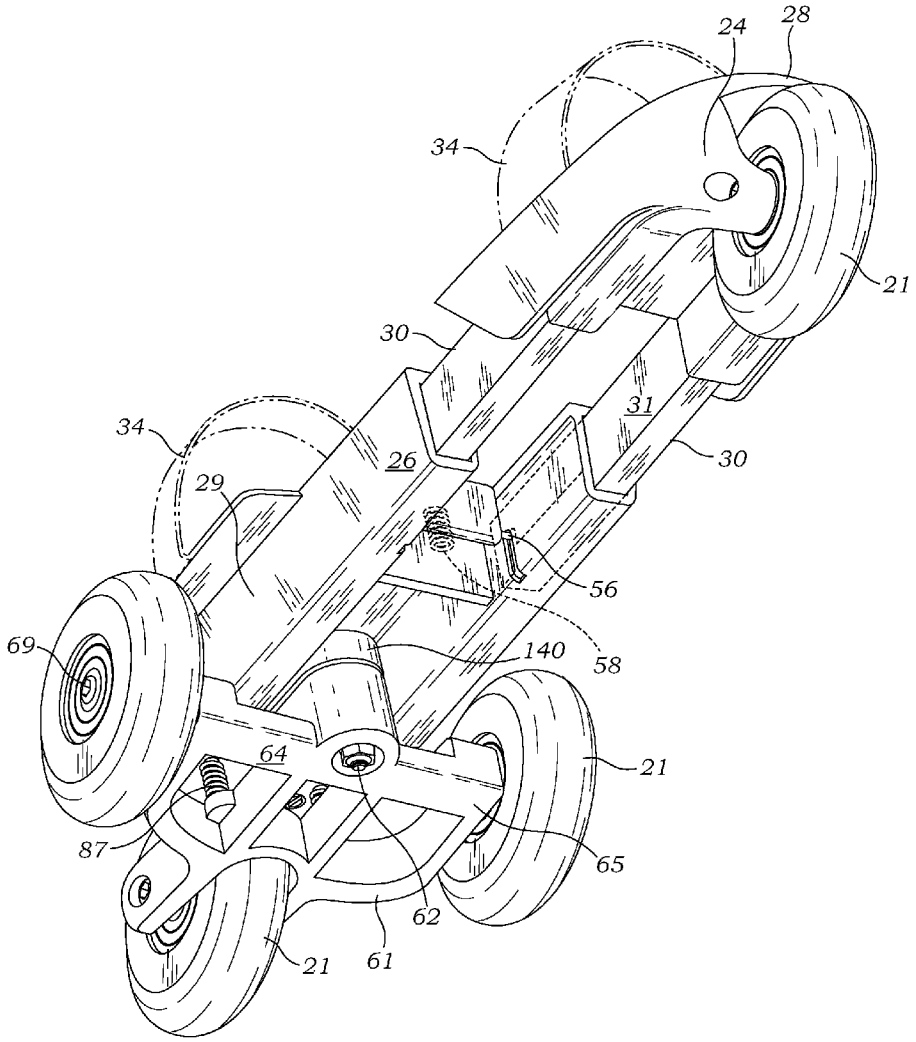
FIG. 13 is a bottom perspective view illustrating a preferred roller skate of the present invention.
Figure 14:
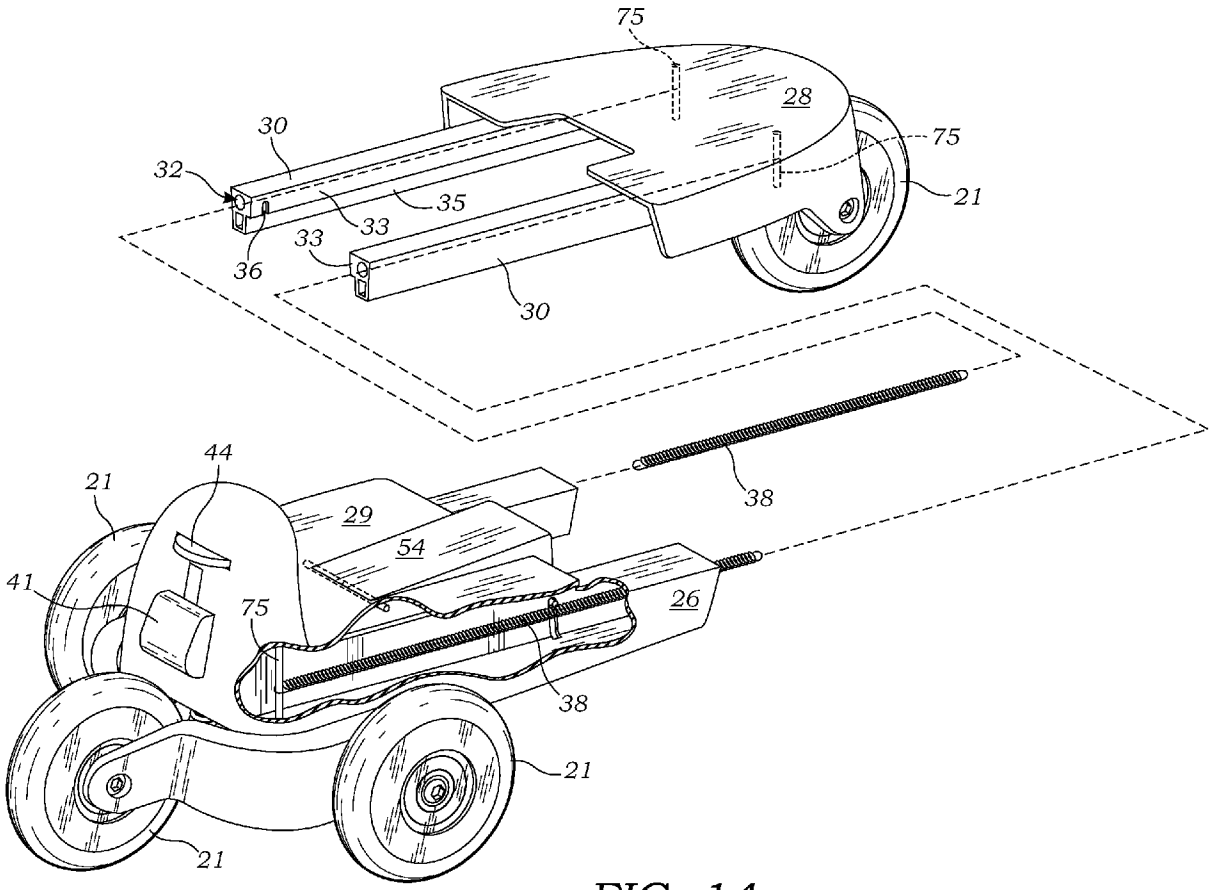
FIG. 14 is a rear perspective exploded view illustrating the connecting assembly of the roller skate of the present invention.

FIGS. 15-23 illustrate a preferred rear wheeled truck assembly. The rear wheel truck assembly includes a rear wheel truck 25 having a central web and side arms 65 which project outwardly to affix a pair of rear wheels 21 connected side-by-side. The wheels are connected by axle screws 69 and elongate nuts 90. In addition, a third rear wheel is affixed to the rear wheel truck at the wheel truck's rearward extremity. Preferably, the rear wheel is affixed utilizing axle screws 96 and a bushing ring 98. In addition, the rear wheel truck assembly includes a t-bolt 82 having a threaded extremity 83, a cross-bar 84 and an engagement arm 85. The t-bolt is affixed to the rear wheel truck 25 with a cushion 86 and nut 88 affixed to the t-bolt's threaded end 83. Meanwhile, the t-bolt affixes to the heel plate 29 by the t-bolt's cross-bar 84 extending into rings 92 affixed to the heel plate's base 51 which forms a pivot mount. Preferably, the skate includes one or more compression springs 87 (as shown in FIG. 13) or tension springs 87 (as shown in FIG. 15) which bias the skate platform 26 downward toward the skating surface.

Figure 20:
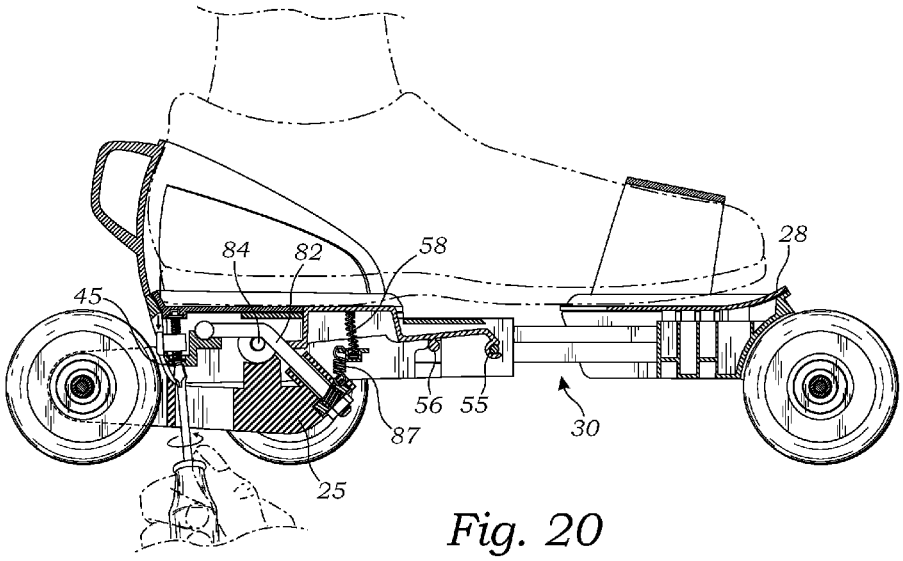
FIG. 20 is a side elevation view of the roller skate wherein the rear brake is being adjusted by a screwdriver.
Figure 21:
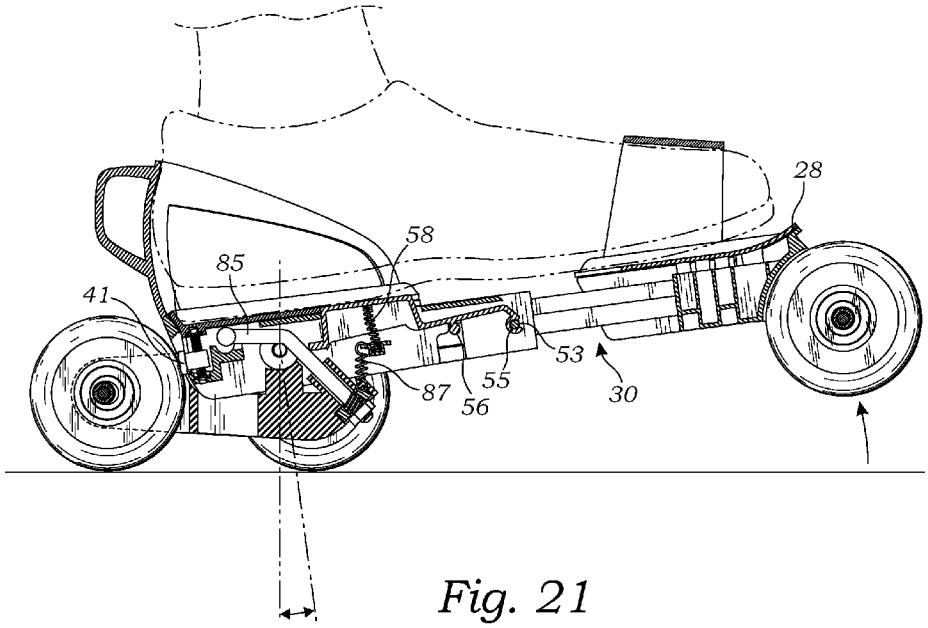
FIG. 21 is a side elevation view of the roller skate wherein the skate platform is tilted rearwardly so that the rear brake pad engages the rear wheel.

As illustrated in FIGS. 20 and 21, the t-bolts cross-bar 84 projects into the center of the rings 92 so as to enable rotational engagement so as to allow the rear wheel truck and rear wheels to pivot about a transverse axis relative to the roller skate's platform. In addition, in the same manner illustrated in FIGS. 6 and 7, the rear wheel truck 25 is capable of rotating about the t-bolt's inclined axis for providing tilting movement of the rear wheels about an inclined longitudinal axis related to the roller skate's platform. As illustrated in FIGS. 20 and 21, the t-bolts extension arm 85 includes an extremity which will engage either the rear wheel truck 25 or engage the underside of the heel plate 29 depending on whether the skater is skating normally with all four wheels upon the skating surface, or whether the skater has tilted the roller skate's platform rearwardly so as to lift the front wheel off the ground. Accordingly, the extension arm 85 functions to prevent the platform from tilting too far forwardly or too far rearwardly.

With reference to FIGS. 24-30, in a preferred embodiment a person's shoe is affixed to the skate by a novel construction including two or more prongs formed on the skate for being received within cavities formed in a person's shoe. As illustrated, for this embodiment the toe plate 28 includes a toe prong 128. The toe prong projects from the rear of the toe plate forwardly above the toe plate's upper surface. Similarly, but in opposite fashion, the heel plate 29 includes a heel prong 129. The heel prong projects forwardly from the rear of the heel plate above the heel plate's upper surface.

As illustrated in FIGS. 28-30, a shoe constructed for affixing to the skate includes two or more cavities which are sized and positioned for receiving the skate's toe and heel prongs. To this end, a shoe's sole is modified so as to include a toe cavity 101 located at the front of the shoe's sole and a heel cavity 102 located at the rear of the shoe's sole. FIGS. 24-26 and 28-30 illustrate an embodiment wherein the skate includes a single toe prong 128 and a single heel prong 129 for projecting into and engaging corresponding toe and heel cavities. Meanwhile, FIG. 27 illustrates a skate having two toe prongs 128 and two heel prongs 129 for projecting into and affixing to corresponding toe and heel cavities. In addition, in other embodiments the skate may include still additional toe and heel prongs for mating to corresponding shoe cavities.

Though the toe and heel plates may be permanently affixed to the rest of the skate's platform by a one piece construction or welding or the like, a preferred construction illustrated in FIGS. 24-27 includes a toe plate which is easily removable and replaceable with other toe plate constructions. For example, a preferred skate is provided with a pair of toe plates and a pair of heel plates, each of which is easily removable or affixable to a corresponding wheel truck. Of these pair of toe plates and heel plates, a first toe plate and a first heel plate are constructed to not include toe prongs, but instead include other means for affixing to a traditional shoe such as straps or the like. Meanwhile, the second toe plate and heel plate are constructed to include one or more toe prongs 128 and heel prongs 129 for projecting into cavities formed in the shoe. The toe plates and heel plates may be removably affixed to the wheel trucks by any number of fasteners known to those skilled in the arts such as threaded fasteners, clips, snap-fit fasteners and the like. Advantageously, providing a skate with toe plates and heel plates with removable and affixable toe plates of alternative constructions allows a skater to alter their footwear as desired.

Preferred brake assemblies are illustrated in FIGS. 8-12. In a first preferred embodiment shown in FIG. 8, the brake assembly 40 includes a knob 44 which rotates a brake screw 23 and causes the brake 41 to move upwardly or downwardly so as to properly engage the rear wheel 21 when the skate platform is tilted rearwardly for braking operation. In an alternative embodiment illustrated in FIGS. 12 and 20, the rotatable knob 44 can be eliminated by providing the brake screw 42 with a slot 45 for acceptance of a traditional or Phillip head screwdriver for moving the brake pad 41 into proper position for engaging the rear wheel 21.

While several particular forms of the invention have been illustrated and described, it will be apparent that various modifications can be made without departing from the spirit and scope of the invention. Therefore, it is not intended that the invention be limited except by the following claims. Having described my invention in such terms as to enable a person skilled in the art to understand the invention, recreate the invention and practice it, and having presently identified the presently preferred embodiments thereof.

We claim:

1. A roller skate comprising:

a platform for supporting a skater's foot, said platform having a toe plate upon which a skater places their toes and a heel plate upon which a skater places their heel;

a front wheel truck secured to said toe plate;

at least one front wheel rotatably connected in transverse axial alignment on said front wheel truck;

a rear wheel truck secured to said heel plate;

at least one rear wheel rotatably connected in transverse axial alignment on said rear wheel truck;

said platform including an adjustable connecting assembly for connecting said front wheel truck to said rear wheel truck, said adjustable connecting assembly providing extension and retraction and a corresponding adjustable length of said platform to accommodate feet of different lengths;

a biasing means for biasing said platform into a retracted condition with said toe plate biased toward said heel plate;

a locking assembly for locking said platform into an extended condition; and a button forming the upper surface of said toe plate or said heel plate so as to project upward from the topside of either front wheel truck or said rear wheel truck so as to engage and be depressed when a skater's foot is placed upon said platform; said button connected to said locking assembly so that depression of said button causes said locking assembly to unlock said platform from an extended condition to allow said biasing means to bias said platform toward a retracted condition.

2. A roller skate as defined in claim 1 wherein said button forms said upper surface of said heel plate so as to engage and be depressed when a skater's heel is placed upon said heel plate.

3. A roller skate as defined in claim 1 wherein:

said connecting assembly includes a pair of rods which telescope into said toe plate or said heel plate; and said biasing means includes a pair of helical compression springs.

4. A roller skate as defined in claim 2 wherein:

said connecting assembly includes a pair of rods which telescope into said heel plate; and said biasing means includes a pair of helical compression springs.

5. A roller skate as defined in claim 1 wherein:

only a single front wheel is rotatably connected in transverse axial alignment on said front wheel truck; and three rear wheels are rotatably connected in transverse axial alignment on said rear wheel truck so as to be in parallel axial alignment with said front wheel, said three rear wheels including a pair or rear wheels connected side-by-by side to form a rear wheel pair, and said three rear wheels includes a center rear wheel positioned rearward and between said rear wheel pair.

6. A roller skate as defined in claim 5 wherein:

said rear wheel truck is connected to said platform for providing tilting movement of said three rear wheels about an inclined longitudinal axis relative to said platform; and said front wheel truck is connected to said platform so as to not provide for tilting movement of said single front wheel about a longitudinal axis relative to said platform.

7. A roller skate as defined in claim 1 wherein:

at least said front wheel truck or said rear wheel truck is connected to said platform by a one-piece t-bolt, said t-bolt including a shaft which extends downwardly at an inclined angle for providing tilting movement of front or rear wheels about an inclined longitudinal axis relative to said platform, said t-bolt including a laterally extending crossbar for connecting to said platform; and said roller skate has a pivot mount secured to the underside of said toe plate or the underside of said heel plate for rotationally receiving said t-bolt crossbar to allow said t-bolt and said front wheel truck or rear wheel truck to pivot about a transverse axis relative to said platform.

8. A roller skate as defined in claim 7 wherein said t-bolt and pivot mount connects said rear truck to said heel plate to allow said rear wheel truck to pivot about a transverse axis relative to said platform.

9. A roller skate as defined in claim 8 wherein said t-bolt includes an extension arm which extends rearwardly from said crossbar, said extension arm engaging said heel plate upon said platform pivoting rearward so as to prevent said platform from pivoting rearward more than a predetermined angle.

10. A roller skate as defined in claim 1 wherein:

said one or more rear wheels include three rear wheels rotatably mounted in transverse axial alignment on said rear wheel truck so as to be in parallel axial alignment with said front wheel, said three rear wheels including a pair or rear wheels mounted side-by-by side to form a rear wheel pair and a center rear wheel positioned rearward and between said rear wheel pair; and said roller skate has a brake including a brake pad mounted to said platform, said brake pad positioned above said rear center wheel so as to engage said rear center wheel when said platform is pivoted rearwardly to as to engage and restrict rotation of said rear center wheel.

11. A roller skate comprising:

a platform for supporting a skater's foot, said platform having a toe plate upon which a skater places their toes and a heel plate upon which a skater places their heel;

a front wheel truck secured to said toe plate;

at least one front wheel rotatably connected in transverse axial alignment on said front wheel truck;

a rear wheel truck secured to said heel plate;

at least one rear wheel rotatably connected in transverse axial alignment on said rear wheel truck;

said platform including an adjustable connecting assembly for connecting said front wheel truck to said rear wheel truck, said adjustable connecting assembly providing extension and retraction and a corresponding adjustable length of said platform to accommodate feet of different lengths;

a biasing means for biasing said platform into a retracted condition with said toe plate biased toward said heel plate;

a locking assembly for locking said platform into an extended condition; and a button forming the upper surface of said heel plate so as to project upward from the topside of said rear wheel truck so as to engage and be depressed when a skater's foot is placed upon said platform; said button connected to said locking assembly so that depression of said button causes said locking assembly to unlock said platform from an extended condition to allow said biasing means to bias said platform toward a retracted condition.

12. A roller skate as defined in claim 11 wherein:

said connecting assembly includes a pair of rods which telescope into said heel plate; and said biasing means includes a pair of helical compression springs.

13. A roller skate as defined in claim 11 wherein:

only a single front wheel is rotatably connected in transverse axial alignment on said front wheel truck which is connected to said platform so as to not provide for tilting movement of said single front wheel about a longitudinal axis relative to said platform; and three rear wheels are rotatably connected in transverse axial alignment on said rear wheel truck so as to be in parallel axial alignment with said front wheel, said three rear wheels including a pair or rear wheels connected side-by-by side to form a rear wheel pair, and said three rear wheels includes a center rear wheel positioned rearward and between said rear wheel pair, said rear wheel truck is connected to said platform for providing tilting movement of said three rear wheels about an inclined longitudinal axis relative to said platform.

* * * * *